US011781302B2

(12) United States Patent
Grybush et al.

(10) Patent No.: US 11,781,302 B2
(45) Date of Patent: Oct. 10, 2023

(54) SINK HAVING REMOVABLE APRON AND ACCESSORY SYSTEMS

(71) Applicant: Kohler Co., Kohler, WI (US)

(72) Inventors: Evan M. Grybush, Belgium, WI (US); Steven F. Elllingsen, Plymouth, WI (US); Niels J. Eilmus, Sheboygan, WI (US); Terrence K. Mahon, Whitefish, WI (US)

(73) Assignee: Kohler Co., Kohler, WI (US)

( * ) Notice: Subject to any disclaimer, the term of this patent is extended or adjusted under 35 U.S.C. 154(b) by 121 days.

(21) Appl. No.: 17/153,508

(22) Filed: Jan. 20, 2021

(65) Prior Publication Data

US 2021/0230851 A1 Jul. 29, 2021

Related U.S. Application Data

(60) Provisional application No. 62/965,530, filed on Jan. 24, 2020.

(51) Int. Cl.
*E03C 1/186* (2019.01)
*E03C 1/33* (2006.01)

(52) U.S. Cl.
CPC ..... *E03C 1/186* (2013.01); *E03C 1/33* (2013.01)

(58) Field of Classification Search
CPC ..... E03C 1/14; E03C 1/16; E03C 1/18; E03C 1/182; E03C 1/186; A47B 77/06; A47B 2096/207; A47B 2096/208; A47B 96/20
USPC ..... D23/284, 285, 290, 239.1, 303, 308
See application file for complete search history.

(56) References Cited

U.S. PATENT DOCUMENTS

| | | | |
|---|---|---|---|
| 208,094 | A | 9/1878 | Higgins |
| 526,390 | A | 9/1894 | Glauber |
| 594,962 | A | 12/1897 | McManus |
| 792,498 | A | 6/1905 | Carr |
| 832,309 | A | 10/1906 | Frey |
| 915,057 | A | 3/1909 | Monahan |
| 948,954 | A | 2/1910 | Cody |
| 958,857 | A | 5/1910 | Dennis |
| 981,448 | A | 1/1911 | Matthews |
| 1,006,994 | A | 10/1911 | Barnes |

(Continued)

FOREIGN PATENT DOCUMENTS

| | | | |
|---|---|---|---|
| CN | 1299430 | A | 6/2001 |
| CN | 1757837 | A | 4/2006 |

(Continued)

OTHER PUBLICATIONS

Office Action for Chinese Application No. 202110089442.2, dated Jun. 6, 2022, 11 pages.

(Continued)

*Primary Examiner* — Erin Deery
(74) *Attorney, Agent, or Firm* — Patterson Thuente, P.A.

(57) ABSTRACT

A sink system includes a basin and an apron. The basin includes a floor, a front wall, and a basin rim. The front wall is contiguous with the floor. The basin rim has a rim front side that is contiguous with the front wall. The rim front side includes an aperture. The apron includes an apron coupling wall. The apron coupling wall is configured to be coupled to the rim front side. The apron coupling wall includes an apron slot that is configured to be aligned with the aperture when the apron is coupled to the basin rim.

18 Claims, 24 Drawing Sheets

(56) References Cited

U.S. PATENT DOCUMENTS

| | | | |
|---|---|---|---|
| 1,225,308 | A | 5/1917 | Born |
| 1,408,812 | A | 3/1922 | Leighton |
| 1,576,607 | A | 3/1926 | Hasskarl |
| 1,579,374 | A | 4/1926 | Leighton |
| 1,587,693 | A | 6/1926 | Beland |
| 1,618,032 | A | 2/1927 | Wikes |
| 1,880,733 | A | 10/1932 | Bolhuis |
| 1,986,935 | A | 1/1935 | Levine |
| 2,005,459 | A | 6/1935 | Finn |
| 2,045,965 | A | 6/1936 | Rosen |
| 2,065,347 | A | 12/1936 | Schulse |
| 2,098,374 | A | 11/1937 | Bullock |
| 2,131,111 | A | 9/1938 | Marsh |
| 2,141,347 | A | 12/1938 | Davis |
| 2,194,343 | A | 3/1940 | Wexler |
| 2,308,123 | A | 1/1943 | Charles |
| 2,309,851 | A | 2/1943 | Kuhne |
| 2,341,093 | A | 2/1944 | Haberstump |
| 2,367,161 | A | 1/1945 | Wild |
| 2,441,752 | A | 5/1948 | Campbell |
| 2,457,918 | A | 1/1949 | Pierce |
| 2,473,862 | A | 6/1949 | Clawsey |
| 2,508,808 | A | 5/1950 | Warman |
| 2,510,238 | A | 6/1950 | Mau |
| 2,534,793 | A | 12/1950 | Olson |
| 2,597,925 | A | 5/1952 | Edger |
| 2,668,300 | A | 2/1954 | Grill |
| 2,691,237 | A | 10/1954 | Heim |
| 2,818,579 | A | 1/1958 | Louis |
| 2,825,177 | A | 3/1958 | Nordlof |
| 2,853,750 | A | 9/1958 | Davies et al. |
| D184,799 | S | 4/1959 | Clemens |
| D188,090 | S | 6/1960 | Rasmussen |
| 2,977,082 | A | 3/1961 | Harris |
| 2,988,755 | A | 6/1961 | Roland |
| 3,023,991 | A | 3/1962 | Fisher |
| 3,051,160 | A | 8/1962 | Nielsen |
| 3,070,812 | A | 1/1963 | Skrmetta |
| 3,142,295 | A | 7/1964 | Blee |
| 3,169,743 | A | 2/1965 | Page, Jr. |
| 3,204,601 | A | 9/1965 | Staver |
| 3,289,218 | A | 12/1966 | Mehilos |
| 3,289,990 | A | 12/1966 | Grantham |
| 3,472,391 | A | 10/1969 | Bolognesi |
| 3,502,384 | A | 3/1970 | Gipson |
| D217,164 | S | 4/1970 | Jarema |
| 3,508,282 | A | 4/1970 | Phillips, Jr. |
| D218,330 | S | 8/1970 | Hagopian |
| 3,552,705 | A | 1/1971 | Caster |
| D222,087 | S | 9/1971 | Hagopian |
| 3,625,162 | A | 12/1971 | Crew |
| D223,501 | S | 4/1972 | Hamburg |
| 3,680,152 | A | 8/1972 | Farrell |
| 3,742,965 | A | 7/1973 | Hudziak |
| 3,813,706 | A | 6/1974 | Williams |
| 3,827,020 | A | 7/1974 | Okamoto |
| 4,033,461 | A | 7/1977 | Nevai |
| 4,041,964 | A | 8/1977 | Shamoon |
| 4,082,391 | A | 4/1978 | Turner |
| D249,207 | S | 9/1978 | Emmer |
| 4,114,967 | A | 9/1978 | Weekly |
| D253,147 | S | 10/1979 | Heckler |
| D253,148 | S | 10/1979 | Heckler |
| D253,149 | S | 10/1979 | Heckler |
| 4,207,975 | A | 6/1980 | Arzillo |
| 4,305,166 | A | 12/1981 | Rose |
| 4,351,073 | A | 9/1982 | Elsas |
| 4,357,957 | A | 11/1982 | Bisonaya et al. |
| 4,370,762 | A | 2/1983 | Heil |
| 4,387,738 | A | 6/1983 | Bisonaya et al. |
| 4,456,021 | A | 6/1984 | Leavens |
| 4,458,705 | A | 7/1984 | Cawood |
| D277,820 | S | 3/1985 | Maayeh |
| 4,531,246 | A | 7/1985 | Earley |
| 4,698,861 | A | 10/1987 | Bogusz |
| 4,720,879 | A | 1/1988 | Rabban |
| 4,884,714 | A | 12/1989 | Bechtel |
| 5,012,537 | A | 5/1991 | Underwood |
| 5,181,285 | A | 1/1993 | Kolada |
| 5,199,119 | A | 4/1993 | Weber |
| 5,217,123 | A | 6/1993 | Riley et al. |
| 5,232,189 | A | 8/1993 | Koch |
| 5,239,711 | A | 8/1993 | Tafur |
| 5,253,752 | A | 10/1993 | Jang |
| D341,049 | S | 11/1993 | Hugh |
| 5,275,363 | A | 1/1994 | Dennis |
| 5,279,007 | A | 1/1994 | Kolada |
| 5,367,278 | A | 11/1994 | Yoshikawa |
| 5,368,268 | A | 11/1994 | Jodwischat |
| D353,652 | S | 12/1994 | Dannenberg |
| 5,377,941 | A | 1/1995 | Har et al. |
| D358,457 | S | 5/1995 | Dannenberg |
| 5,417,397 | A | 5/1995 | Harnett |
| D365,235 | S | 12/1995 | Jodwischat |
| 5,485,859 | A | 1/1996 | Johnson et al. |
| 5,485,927 | A | 1/1996 | Hubbard |
| D375,219 | S | 11/1996 | Selent |
| 5,590,804 | A | 1/1997 | Crum et al. |
| 5,642,871 | A | 7/1997 | Repert et al. |
| 5,715,547 | A | 2/1998 | Becker et al. |
| 5,864,898 | A | 2/1999 | Knapp et al. |
| 5,865,325 | A | 2/1999 | Comstock |
| 5,940,906 | A | 8/1999 | Halloran |
| 5,947,439 | A | 9/1999 | Florey |
| D421,490 | S | 3/2000 | Talerico |
| 6,062,397 | A | 5/2000 | Licari |
| 6,092,772 | A | 7/2000 | Garcia et al. |
| 6,154,895 | A | 12/2000 | Pisklak |
| 6,212,707 | B1 | 4/2001 | Thompson et al. |
| 6,216,992 | B1 | 4/2001 | Bisonaya et al. |
| 6,223,362 | B1 | 5/2001 | Liang |
| D444,216 | S | 6/2001 | Katz et al. |
| D444,548 | S | 7/2001 | Katz et al. |
| D444,549 | S | 7/2001 | Katz et al. |
| 6,276,675 | B1 | 8/2001 | Shamoon |
| D451,585 | S | 12/2001 | Svendsen et al. |
| 6,330,948 | B1 | 12/2001 | Leto |
| 6,338,171 | B1 | 1/2002 | Dandridge |
| 6,341,704 | B1 | 1/2002 | Michel, Jr. |
| 6,341,770 | B1 | 1/2002 | Landherr |
| D458,493 | S | 6/2002 | Cascio |
| D458,494 | S | 6/2002 | Cascio |
| 6,446,280 | B1 | 9/2002 | Moore, Jr. |
| D473,294 | S | 4/2003 | Genslak et al. |
| 6,557,956 | B2 | 5/2003 | Hightower |
| 6,564,398 | B1 | 5/2003 | Trott |
| D477,949 | S | 8/2003 | Cascio et al. |
| D477,950 | S | 8/2003 | Cascio et al. |
| D478,444 | S | 8/2003 | Cascio et al. |
| 6,619,604 | B1 | 9/2003 | Stillman |
| 6,658,677 | B2 | 12/2003 | Paul |
| D484,956 | S | 1/2004 | Rachiele |
| D492,983 | S | 7/2004 | Rachiele |
| D494,257 | S | 8/2004 | Moran et al. |
| D494,665 | S | 8/2004 | Herbeau |
| 6,793,190 | B2 | 9/2004 | White |
| 6,793,193 | B2 | 9/2004 | De Groote |
| 6,808,147 | B2 | 10/2004 | Brannen et al. |
| D498,291 | S | 11/2004 | Bayer |
| D499,468 | S | 12/2004 | Trepanier |
| D499,799 | S | 12/2004 | Trepanier |
| D499,800 | S | 12/2004 | Trepanier |
| D501,041 | S | 1/2005 | Moran et al. |
| D501,541 | S | 2/2005 | Gordon |
| 6,857,616 | B1 | 2/2005 | Gasperi et al. |
| 6,910,604 | B2 | 6/2005 | Gugliotti et al. |
| D507,041 | S | 7/2005 | Douglass et al. |
| D508,984 | S | 8/2005 | Gordon |
| 6,929,232 | B1 | 8/2005 | Gasperi et al. |
| 6,991,200 | B2 | 1/2006 | Stillman |
| D518,560 | S | 4/2006 | Arkay-Leliever |
| D520,611 | S | 5/2006 | Wozniczka et al. |
| D520,612 | S | 5/2006 | Wozniczka et al. |
| 7,039,963 | B2 | 5/2006 | Loberger et al. |

(56) References Cited

U.S. PATENT DOCUMENTS

D525,689 S 7/2006 Wozniczka et al.
7,086,099 B2 8/2006 Rocci
D527,808 S 9/2006 Wozniczka et al.
D529,148 S 9/2006 Douglass
D529,999 S 10/2006 Lonneman et al.
D530,001 S 10/2006 Lonneman et al.
D530,403 S 10/2006 Lonneman et al.
D530,404 S 10/2006 Lonneman et al.
D530,405 S 10/2006 Douglass et al.
D530,797 S 10/2006 Lonneman
D537,149 S 2/2007 Douglass et al.
7,178,886 B2 2/2007 Hightower
D537,997 S 3/2007 Plikuhn
D538,497 S 3/2007 Plikuhn
D539,396 S 3/2007 Plikuhn et al.
D544,074 S 6/2007 Douglass et al.
D545,408 S 6/2007 Plikuhn
D545,409 S 6/2007 Plikuhn
D546,426 S 7/2007 Plikuhn
D546,929 S 7/2007 Schneider et al.
D547,838 S 7/2007 Plikuhn
7,246,387 B2 7/2007 Erickson et al.
D548,311 S 8/2007 Mahon
D551,742 S 9/2007 Plikuhn
D552,222 S 10/2007 Tortorello
7,278,175 B2 10/2007 Torres
D556,297 S 11/2007 Baade et al.
D556,848 S 12/2007 Ruggiero et al.
D556,868 S 12/2007 Tortorello
D558,311 S 12/2007 Adams
7,305,723 B2 12/2007 Fulks
D559,366 S 1/2008 Chong
7,377,661 B2 5/2008 Douglass
D573,701 S 7/2008 Rachiele
7,424,949 B2 9/2008 Kumar
D585,126 S 1/2009 Eilmus et al.
7,481,473 B1 1/2009 Warning
D587,789 S 3/2009 Drake
D587,790 S 3/2009 Tortorello et al.
D588,677 S 3/2009 Drake
D588,678 S 3/2009 Chong et al.
D588,679 S 3/2009 Cheng
D588,680 S 3/2009 Cheng
D588,685 S 3/2009 Chong
D589,222 S 3/2009 Gicela et al.
7,503,534 B2 3/2009 Pollack
7,568,239 B2 8/2009 Spruner Von Mertz et al.
7,578,399 B1 8/2009 Mulaw
D600,334 S 9/2009 Chong
7,594,706 B2 9/2009 Styka et al.
D603,026 S 10/2009 Deboer et al.
D603,027 S 10/2009 Deboer et al.
D603,029 S 10/2009 Bucher
D603,334 S 11/2009 Suzuki
D603,486 S 11/2009 Mayer et al.
7,699,277 B2 4/2010 Bagnall
7,721,362 B2 5/2010 Martin et al.
7,726,521 B2 6/2010 Bassett et al.
7,731,846 B1 6/2010 Jones
7,735,661 B1 6/2010 Sumner et al.
D624,635 S 9/2010 Eckhaus
D627,449 S 11/2010 Eckhaus
7,841,473 B2 11/2010 Huang et al.
7,854,030 B2 12/2010 Lee et al.
D636,138 S 4/2011 Talerico
8,070,148 B2 12/2011 Nishida
D651,699 S 1/2012 Booth et al.
8,088,468 B2 1/2012 Maggio
8,096,678 B2 1/2012 Jones et al.
D655,798 S 3/2012 Miller et al.
D657,028 S 4/2012 Eilmus
8,185,980 B2 5/2012 Adams et al.
D662,574 S 6/2012 Booth et al.
D663,389 S 7/2012 Miller et al.
D663,395 S 7/2012 Miller et al.
8,214,939 B2 7/2012 Spurlock
8,296,876 B2 10/2012 Yang et al.
D670,364 S 11/2012 Miller et al.
D670,366 S 11/2012 Booth et al.
D670,367 S 11/2012 Miller et al.
D671,197 S 11/2012 Miller et al.
D675,300 S 1/2013 Miller et al.
8,393,022 B2 3/2013 Dachowski
D682,998 S 5/2013 Eilmus
D685,456 S 7/2013 Eckhaus
D685,457 S 7/2013 Eckhaus
8,484,916 B2 7/2013 Farag
8,511,762 B2 8/2013 Stegerwald
D698,905 S 2/2014 Ziemann et al.
D699,012 S 2/2014 Ziemann et al.
D699,013 S 2/2014 Ziemann et al.
D699,330 S 2/2014 Ziemann et al.
D700,301 S 2/2014 Rachiele
8,684,192 B1 4/2014 Margolin
8,801,926 B2 8/2014 Housley
8,844,070 B2 9/2014 Booth et al.
8,870,306 B2 10/2014 Simon
8,925,124 B2 1/2015 Littlehorn, Sr.
D722,145 S 2/2015 Morales et al.
D725,757 S 3/2015 Morales et al.
9,032,567 B1 5/2015 Galgano
9,066,631 B2 6/2015 Didehvar et al.
9,073,096 B2 7/2015 Ehman
9,085,884 B2 7/2015 Lopchinsky
9,115,484 B2 8/2015 Fulford et al.
9,173,487 B2 11/2015 Booth et al.
9,226,621 B1 1/2016 Jones et al.
9,228,331 B1 1/2016 Weinstein
9,238,907 B2 1/2016 Murray
9,260,845 B1 2/2016 Siegel
9,291,301 B2 3/2016 Brinkmann
9,380,917 B2 7/2016 Eilmus et al.
9,414,717 B2 8/2016 Tollasepp et al.
9,416,538 B2 8/2016 Torres et al.
9,427,135 B2 8/2016 Audet et al.
9,567,735 B2 2/2017 Siegel
9,574,333 B2 2/2017 O'Brien et al.
9,622,621 B2 4/2017 Brinkmann
9,708,064 B2 7/2017 Vandewall et al.
9,750,375 B2 9/2017 Byun
D799,648 S 10/2017 Chong
D799,649 S 10/2017 Chong
9,775,470 B2 10/2017 Eilmus et al.
9,783,967 B2 10/2017 Jain et al.
9,790,671 B2 10/2017 Jones et al.
9,808,123 B1 11/2017 Brinkmann
D804,620 S 12/2017 Palazzolo et al.
D816,197 S 4/2018 Chong et al.
9,930,998 B2 4/2018 Palazzolo et al.
D821,670 S 6/2018 Lynch
D824,628 S 7/2018 Lynch
10,092,097 B2 10/2018 Booth et al.
10,151,085 B2 12/2018 Chong et al.
D845,451 S 4/2019 Swilley
D861,837 S 10/2019 Chong et al.
D865,138 S 10/2019 Lyons
10,501,919 B2 12/2019 Chong et al.
D872,243 S 1/2020 Wegner et al.
D886,255 S 6/2020 Wegner et al.
D911,497 S 2/2021 Levi
11,149,421 B2 * 10/2021 Liang ..... E03C 1/18
2004/0016052 A1 1/2004 Domenig
2005/0044625 A1 3/2005 Kommers
2005/0155147 A1 7/2005 Trepanier et al.
2005/0223486 A1 10/2005 Jumalon
2007/0157378 A1 7/2007 Kendall et al.
2009/0094741 A1 4/2009 Valadez et al.
2009/0139023 A1 6/2009 Talerico
2009/0172876 A1 7/2009 Hendrickson et al.
2009/0314730 A1 12/2009 Mansikkamaa
2010/0072147 A1 3/2010 Reenberg et al.
2010/0116955 A1 5/2010 Hayes et al.
2010/0148896 A1 6/2010 Hugo
2010/0213145 A1 8/2010 Swank

(56) References Cited

U.S. PATENT DOCUMENTS

| | | | |
|---|---|---|---|
| 2010/0254125 | A1 | 10/2010 | Jones et al. |
| 2010/0275367 | A1 | 11/2010 | Bager et al. |
| 2010/0275368 | A1 | 11/2010 | Miller et al. |
| 2010/0275369 | A1 | 11/2010 | Eilmus et al. |
| 2011/0056016 | A1 | 3/2011 | Mun |
| 2011/0101199 | A1 | 5/2011 | Andrade |
| 2011/0163510 | A1 | 7/2011 | Wedi |
| 2011/0219535 | A1 | 9/2011 | Bouroullec et al. |
| 2011/0303626 | A1 | 12/2011 | Roenne |
| 2012/0169192 | A1 | 7/2012 | Simon |
| 2012/0222211 | A1 | 9/2012 | Booth et al. |
| 2012/0240330 | A1 | 9/2012 | Fulford et al. |
| 2013/0337220 | A1 | 12/2013 | Janke |
| 2014/0041113 | A1 | 2/2014 | Mobbs |
| 2014/0245533 | A1 | 9/2014 | Lee et al. |
| 2014/0259381 | A1 | 9/2014 | Fogerlie |
| 2014/0346102 | A1 | 11/2014 | Housley |
| 2014/0366263 | A1 | 12/2014 | Thompson et al. |
| 2015/0122961 | A1 | 5/2015 | Batiste et al. |
| 2015/0128339 | A1 | 5/2015 | Warner |
| 2015/0230667 | A1 | 8/2015 | Palazzolo et al. |
| 2015/0284937 | A1 | 10/2015 | Baier et al. |
| 2016/0045027 | A1 | 2/2016 | Alkoby |
| 2016/0215484 | A1 | 7/2016 | Williams |
| 2016/0235201 | A1 | 8/2016 | Soot |
| 2016/0256804 | A1 | 9/2016 | Medeiros |
| 2017/0027387 | A1 | 2/2017 | Lakshmi Narasimhan |
| 2017/0130433 | A1 | 5/2017 | Franco |
| 2017/0172379 | A1 | 6/2017 | Keller et al. |
| 2017/0245693 | A1 | 8/2017 | Palazzolo et al. |
| 2017/0295960 | A1 | 10/2017 | Allen |
| 2018/0030702 | A1 | 2/2018 | Childs et al. |
| 2018/0030703 | A1 | 2/2018 | Cagliari et al. |
| 2018/0030704 | A1 | 2/2018 | Bomatter et al. |
| 2018/0030705 | A1 | 2/2018 | Bomatter et al. |
| 2018/0125305 | A1 | 5/2018 | Richards |
| 2018/0187400 | A1 | 7/2018 | Chong et al. |
| 2018/0187401 | A1 | 7/2018 | Chong et al. |
| 2018/0187403 | A1* | 7/2018 | Chong ..... E03C 1/18 |
| 2020/0063412 | A1 | 2/2020 | Miller et al. |
| 2020/0352331 | A1 | 11/2020 | Graf |

FOREIGN PATENT DOCUMENTS

| | | | |
|---|---|---|---|
| CN | 1938495 | A | 3/2007 |
| CN | 102105642 | A | 6/2011 |
| CN | 102791919 | A | 11/2012 |
| CN | 104912281 | A | 9/2015 |
| CN | 105496036 | A | 4/2016 |
| CN | 205242533 | U | 5/2016 |
| CN | 105908812 | A | 8/2016 |
| CN | 105908812 | A | 8/2016 |
| CN | 207285669 | | 5/2018 |
| CN | 108567358 | A | 9/2018 |
| CN | 209653051 | U | 11/2019 |
| DE | 26 58 193 | B1 | 7/1978 |
| DE | 39 28 806 | A1 | 11/1990 |
| EP | 0 534 517 | A1 | 3/1993 |
| EP | 0 968 078 | | 1/2000 |
| EP | 1 442 691 | A1 | 8/2004 |
| EP | 2 168 750 | A1 | 3/2010 |
| EP | 2 194 196 | A2 | 6/2010 |
| EP | 2 803 772 | A2 | 11/2014 |
| EP | 3 670 768 | A1 | 6/2020 |
| ES | 2301357 | A1 | 6/2008 |
| FR | 2887416 | B1 | 11/2008 |
| GB | 2 214 127 | A | 8/1989 |
| JP | S5555842 | A | 4/1980 |
| JP | 937863 | A | 2/1997 |
| JP | H937863 | A | 2/1997 |
| JP | H119487 | A | 1/1999 |
| JP | H119488 | A | 1/1999 |
| JP | H11-346951 | A | 12/1999 |
| JP | 5088124 | B2 | 12/2012 |
| JP | 2017127378 | A | 7/2017 |
| WO | WO-2012/069682 | A1 | 5/2012 |
| WO | WO-2012/134118 | A2 | 10/2012 |
| WO | WO-2016/062519 | A1 | 4/2016 |

OTHER PUBLICATIONS

Extended European Search Report on EP Appln. Ser. No. 21153093.6 dated Sep. 22, 2021 (16 pages).

Office Action corresponding to CN 202110088067.5 dated Jun. 6, 2022.

English Summary of Office Action corresponding to CN 202110088067.5 dated Jun. 6, 2022.

Blanco America, "Blanco's New ONE Stainless Steel Sinks," retrieved from https://youtu.be/ITta7oPFXgA, pp. 1-19 (2014). https://youtu.be/ITta7oPFXgA; accessed Jan. 5, 2021.

FIFTV Kitchen & Bath Fixtures from Kraus USA Video Snippets, https://www.youtube.com/watch?v=48iJF4PKAqA, accessed Sep. 14, 2020, pp. 1-16 https://www.youtube.com/watch?v=48iJF4PKAqA; accessed Jan. 5, 2021.

"BLANCO ONE™ Super Single Bowl," retrieved from https://www.bianco.com/en_us/en_us/sinks/product_catalog/sink.html?sid=BLANCO ONE Super Single Bowl&filter=true, 3 pages (no date).

"ELXUFP3620: Elkay Quartz Luxe 35-7/8" x 20-15/16" x 9" Single Bowl Farmhouse Sink with Perfect Drain," retrieved from https://www.elkay.com/products/elxufp3620.html, 2 pages (no date).

Belle Foret. "Apron Front Kitchen Sink". Model No. BFF1KIT. BelleForet.com online catalog. All Contents Copyright, Your'Other Warehouse. (1 page).

Bellucci 30" Flat Apron Front Granite Quartz Composite Single Bowl Kitchen Sink in Brown, https://www.kraususa.com/kraus-kgf1-30brown-30-flat-apron-front-granite-quartz-composite-single-bowl-kitchen-sink-in-brown.html, accessed Sep. 14, 2020, pp. 1-4.

Bellucci 30" Flat Apron Front Granite Quartz Composite Single Bowl Kitchen Sink in White, https://www.kraususa.com/kraus-kgf1-30white-30-flat-apron-front-granite-quartz-composite-single-bowl-kitchen-sink-in-white.html, accessed Sep. 14, 2020, pp. 1-4.

Bellucci 30" Flat Apron Granite Quartz Composite Single Bowl Kitchen Sink in Black, https://www.kraususa.com/kraus-kgf1-30black-30-flat-apron-front-granite-quartz-composite-single-bowl-kitchen-sink-in-black.html, accessed Sep. 14, 2020, pp. 1-4.

Bellucci 33" Flat Apron Front Granite Quartz Composite Single Bowl Kitchen Sink in Black, https://www.kraususa.com/kraus-kgf1-33black-33-flat-apron-front-granite-quartz-composite-single-bowl-kitchen-sink-in-black.html, accessed Sep. 14, 2020, pp. 1-5.

Bellucci 33" Flat Apron Front Granite Quartz Composite Single Bowl Kitchen Sink in Brown, https://www.kraususa.com/kraus-kgf1-33brown-33-flat-apron-front-granite-quartz-composite-single-bowl-kitchen-sink-in-brown.html, accessed Sep. 14, 2020, pp. 1-4.

Bellucci 33" Flat Apron Front Granite Quartz Composite Single Bowl Kitchen Sink in White, Model KGF1-33, https://www.kraususa.com/kraus-kgf1-33white-33-flat-apron-front-granite-quartz-composite-single-bowl-kitchen-sink-in-white.html, accessed Sep. 14, 2020, pp. 1-5.

Bellucci by Kraus—Flat Apron-Front Farmhouse Kitchen Sink Video Snippets, https://www.youtube.com/watch?v=bzwDrUpAPUg, accessed Sep. 14, 2020, pp. 1-7.

Bellucci Workstation 33" Quartz Composite Single Bowl Farmhouse Kitchen Sink in Metallic Brown, https://www.kraususa.com/kraus-kgf2-33mbr-workstation-33-quartz-composite-single-bowl-farmhouse-kitchen-sink-in-metallic-brown.html, accessed Sep. 14, 2020, pp. 1-4.

Bellucci Workstation 33" Quartz Composite Single Bowl Farmhouse Kitchen Sink in Metallic Grey, https://www.kraususa.com/kraus-kgf2-33mgr-workstation-33-quartz-composite-single-bowl-farmhouse-kitchen-sink-in-metallic-grey.html, accessed Sep. 14, 2020, pp. 1-4.

BLANCO America, "BLANCO's New ONE Stainless Steel Sinks," retrieved from https://youtu.be/ITta7oPFXgA, pp. 1-19 (2014).

FIFTV Kitchen & Bath Fixtures from Kraus USA Video Snippets, https://www.youtube.com/watch?v=48iJF4PKAqA, accessed Sep. 14, 2020, pp. 1-16.

(56) References Cited

OTHER PUBLICATIONS

Foreign Action other than Search Report on CN 201910763481.4 dated Jul. 30, 2020 (11 pages).
Foreign Action other than Search Report on CN 201910763481.4 dated Sep. 16, 2019 [no English translation].
Instawares.com. GSW Stainless Steel Corner Drain Sink Bowl—18.times.24in. Instawares.com online catalog. (1 page).
Kallista. "For Loft by Michael S. Smith Fireclay Kitchen Sink with Drajnboard." Model No. L20300. Kallista.com online catalog. Copyright 2011 Kohler Co. (2 pages).
Kallista. "For Loft by Michael S. Smith Fireclay Kitchen Sink." Model No. L20301. Kallista.com online catalog. Copyright 2011 Kohler Co. (2 pages).
Kallista. For "Town by Michael S. Smith Fireclay Kitchen Sink." Model No. L20303. Kallista.com online catalog. Copyright 2011 Kohler Co. (2 pages).
Kohler Co. "Dickinson Apron-Front, Tile-in Kitchen Sink". Model No. K-6546-3. Kohler Co. online catalog. Copyright 2011 Kohler Co. (3 pages).
Kohler Co. "Dickinson Apron-Front, Tile-in Kitchen Sink". Model No. K-6546-4. Kohler Co. online catalog. Copyright 2011 Kohler Co. (3 pages).
Kohler Co. "Dickinson Apron-Front, Tile-in Kitchen Sink". Model No. K-6546-4U. Kohler Co. online catalog. Copyright 2011 Kohler Co. (3 pages).
Kohler Co. "Hawthorne Apron-Front, Tile-in Kitchen Sink". Model No. K-6534-3. Kohler Co. online catalog. Copyright 2011 Kohler Co.. (3 pages).
Kohler Co. "Hawthorne Apron-Front, Tile-in Kitchen Sink". Model No. K-6534-4. Kohler Co. online catalog. Copyright 2011 Kohler Co. (3 pages).
Kohler Co. "Hawthorne Apron-Front, Tile-in Kitchen Sink". Model No. K-6534-4U. Kohler Co. online catalog. Copyright 2011 Kohler Co. (3 pages).
Kohler Fixtures, Apron Front Sinks, pp. 352-355 (2014).
Kore Workstation 30" Apron Front 16 Guage Stainless Steel Single Bowl Kitchen Sink, https://www.kraususa.com/kraus-kwf410-30-workstation-30-apron-front-16-gauge-stainless-steel-single-bowl-kitchen-sink.html, accessed Sep. 14, 2020, pp. 1-4.
Kraus Bellucci Sink Collection Video Snippets, https://www.youtube.com/watch?v=O_MFn1JLOTg#action=share, accessed Sep. 14, 2020, pp. 1-8.
Kraus Forteza KGF1-33 Farmhouse Apron Kitchen Sink, https://www.wayfair.com/home-improvement/pdp/kraus-forteza-33-I-x-21-w-farmhouseapron-kitchen-sink-kus10133.html?piid=40371630, accessed Sep. 14, 2020, pp. 1-9.
Kraus Installation Guide, "Bellucci Quartz Granite Composite Farmhouse Sink with CeramTek," KGF1-30/KGF1-33, www.kraususa.com, Dec. 3, 2018, pp. 1-15.
Kraus Installation Guide, "Bellucci Quartz Granite Composite Farmhouse Sink," KGF1-30 / KGF1-33, KGF2-30 / KGF2-33, KGF11-30 / KGF11-33, KGF12-30 / KGF12-33, www.kraususa.com, Feb. 19, 2019, pp. 1-15.
Kraus Installation Guide, "Bellucci Quartz Granite Composite Farmhouse Sink," KGF1-30/KGF1-33, KGF2-30/KGF2-33, KGF11-30/KGF11-33, KGF12-30/KGF12-33, www.kraususa.com, Feb. 19, 2019, 1-15.
Kraus Specification Sheet, "KGF1-33 33 Inch Single Bowl Granite Farmhouse Apron Kitchen Sink," www.kraususa.com, Jun. 10, 2019, 1 page.
Linkasink Farm House Kitchen Sink with Inset Apron Front, C071-30 SS, https://static1.squarespace.com/static/5706844ee707eb7087c2faa7/t/590781fc1e5b6c7f60ac7e2f/1493664254854/c071-30_ss_spec_sheet.pdf, accessed Dec. 15, 2020, pp. 1-3.
Lyons. "Premium 34 .times. 23 Apron Sink". Model No. KSxxAP3.4. Lyons brochure. (3 pages).
Rachiele, "Patented copper apron front sink with channel;" http://www.rachiele.com/copper.sub.--apron.sub.--sinks-with-patent.asp; retrieval date: Nov. 30, 2011; 3 pages.
Rohl. Apron Front Sink. (4 pages).
Screen capture from Dawn USA showing HTML coding with product installation manual date. Retrieved from http://dawnusa.net/productsee4. Screen capture from amazon, com showing earliest available date for sink model DAF3320C dated Oct. 16, 2017 (2 pages).
Shaws Original. Apron Sink. (1 page).
Songbath.com. Apron Front Kitchen Sink. Songbath.com online catalog. (1 page).
Standart PRO 33" Flat Apron Front 16 Guage Stainless Steel Single Bowl Kitchen Sink, Model KHF410-33, https://www.kraususa.com/kraus-khf410-33-33-flat-apron-front-16-gauge-stainless-steel-single-bowl-kitchen-sink.html, accessed Sep. 14, 2020, pp. 1-4.
Wobane Under Cabinet Lighting Kit, https://www.amazon.com/Lighting-Flexible-LED-Cupboard-WarmWhite/dp/B07BF5PB4G/ref=pd_bxgy_img_2/130-1786452-9365555?_encoding=UTF8&pd_rd_i=B07BF5PB4G&pd_rd_r=28e0b463-27d9-4394-bb05-97c57e6bfb1c&pd_rd_w=kLfbC&pd_rd_wg=3R6PF&pf_rd_p=4e3f7fc3-00c8-46a6-a4db-8457e6319578&pf_rd_r=0F23CBD7138W0BTR097T&psc=1 &refRID=0F23CBD7138W0BTR097T, pp. 1-12, accessed Jun. 18, 2020.
Extended European Search Report on EP Appl. Ser. No. 21180585.8 dated Nov. 9, 2021 (12 pages).
First Indian Examination Report on IN App. Ser. No. 202114003244 dated Jan. 4, 2022 (6 pages).
First Indian Examination Report on IN Appl. Ser. No. 202114003243 dated Jan. 12, 2022 (7 pages).
Elite Bath Chameleon Stainless, http://elitebath.com/stainless.html, accessed Apr. 19, 2021, pp. 1-2.
Texas Lightsmith Luminescent Sinks, https://www.texaslightsmith.com/luminescent-sinks/, accessed Apr. 19, 2021, pp. 1-32.
Chinese Second Office Action on CN Patent Application No. 201910763481.4 dated Mar. 11, 2021 (7 pages).
Chinese Office Action on CN Appl. Ser. No. 201910763481.4 dated Jul. 30, 2020 (11 pages).
European Search Report on EP 21153093.6 dated Jun. 9, 2021 (20 pages).
European Search Report on EP 21153120.7 dated Jun. 28, 2021 (9 pages).
Third Chinese Office Action on CN Patent Application No. 201910763481.4 dated Aug. 10, 2021 (9 pages).
European Office Action Corresponding to EP 21153120.7 dated Jun. 9, 2023.

* cited by examiner

SINK HAVING REMOVABLE APRON AND ACCESSORY SYSTEMS

CROSS-REFERENCE TO RELATED PATENT APPLICATION

This application claims the benefit of and priority to U.S. Provisional Patent Application No. 62/965,530, filed Jan. 24, 2020, the entire disclosure of which is incorporated herein by reference.

BACKGROUND

The present application relates generally to sink systems, and more particularly to sinks that incorporate various features intended to provide enhanced functionality for such sinks.

SUMMARY

In one embodiment, a sink system includes a basin and an apron. The basin includes a floor, a front wall, and a basin rim. The front wall is contiguous with the floor. The basin rim has a rim front side that is contiguous with the front wall. The rim front side includes an aperture. The apron includes an apron coupling wall. The apron coupling wall is configured to be coupled to the rim front side. The apron coupling wall includes an apron slot that is configured to be aligned with the aperture when the apron is coupled to the basin rim.

In another embodiment, an apron for a sink system includes an apron panel wall and an apron coupling wall. The apron coupling wall is contiguous with the apron panel wall. The apron coupling wall includes an inner recessed portion, an outer recessed portion, and an apron shelf. The inner recessed portion includes a plurality of apron slots. Each of the plurality of apron slots is configured to receive a portion of a threaded fastener. The apron shelf separates the inner recessed portion from the outer recessed portion.

In yet another embodiment, a basin for a sink system includes a floor, a front wall, and a basin rim. The floor is disposed along a first plane. The front wall is contiguous with the floor. The basin rim has a rim front side that is contiguous with the front wall. The rim front side includes a rim shelf, an attachment recess, a stepped portion, and an aperture. The rim shelf is disposed along a second plane that is separated from the first plane by a first distance. The attachment recess is disposed in the rim shelf and disposed along a straight line. The stepped portion is contiguous with the front wall, disposed between the front wall and at least a portion of the rim shelf, and disposed along a third plane that is separated from the first plane by a second distance that is less than the first distance. The aperture is disposed in the stepped portion.

BRIEF DESCRIPTION OF THE DRAWINGS

The details of one or more implementations are set forth in the accompanying drawings and the description below. Other features, aspects, and advantages of the disclosure will become apparent from the description, the drawings, and the claims, in which:

Figure 1:
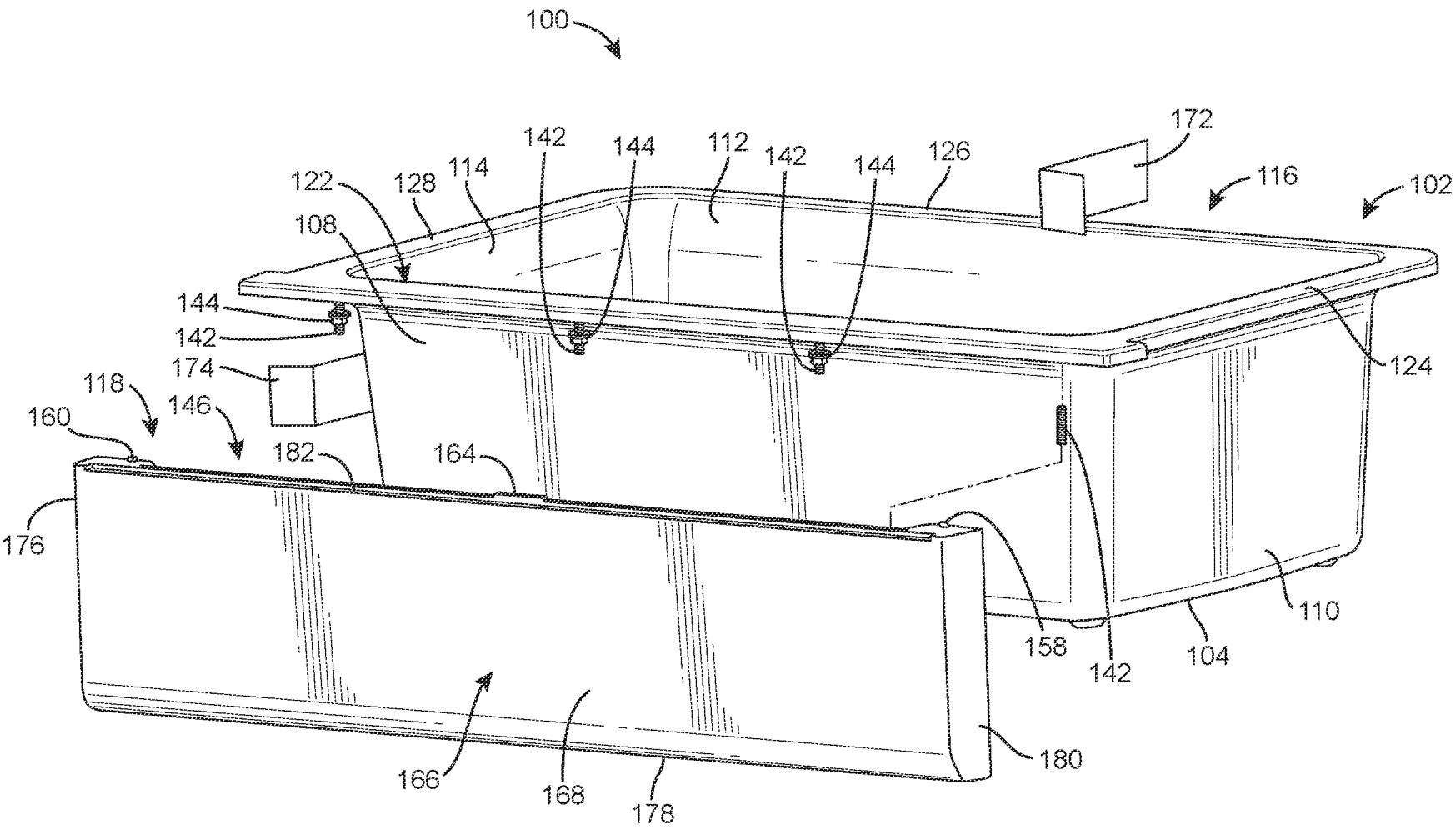
FIG. 1 is a front perspective and exploded view of a sink system according to an example embodiment.

It will be recognized that some or all of the Figures are schematic representations for purposes of illustration. The Figures are provided for the purpose of illustrating one or more implementations with the explicit understanding that they will not be used to limit the scope or the meaning of the claims.

DETAILED DESCRIPTION

Following below are more detailed descriptions of various concepts related to, and implementations of, methods, apparatuses, and for sinks. The various concepts introduced above and discussed in greater detail below may be implemented in any of a number of ways, as the described concepts are not limited to any particular manner of implementation. Examples of specific implementations and applications are provided primarily for illustrative purposes.

I. Overview

Sinks are used frequently in daily life in various environments, such as kitchens, bathrooms, laundry rooms, and the like. Depending on the intended use of the sink, it may be advantageous to utilize various accessories with the sink (e.g., sponges, wash cloths, towels, etc.). In some cases, individuals may utilize auxiliary devices, such as stick-on hooks, soap and brush containers, and removable drain stoppers in order to provide their sink with additional desired functionality. However, these auxiliary devices may have an undesirable appearance or provide an overall cluttered and inelegant look to the sink environment. Furthermore, this undesirable appearance may become increasingly undesirable as use of the auxiliary devices increases become grime and dirt can accumulate on the auxiliary devices.

Implementations described herein are directed to sink systems that provide several functional features without requiring the use of auxiliary devices. As a result, the sink systems described herein may have a superior aesthetic appearance and enhanced functionality as compared to other sinks which do require the use of auxiliary devices.

Some implementations described herein are directed to a sink system that includes a basin and an apron. The basin and apron are attached using threaded fasteners and define an apron attachment channel within which an apron accessory can be received when the apron is coupled to the basin. Advantageously, the apron accessory can be inserted into, removed from, and slid within the apron attachment channel while the apron remains coupled to the basin.

Some implementations described herein are directed to a sink system that includes a basin channel within the basin. The basin channel is configured to facilitate coupling to a basin accessory. As a result, the basin accessory may be supported within the basin and suspended above a floor of the basin, by the basin channel.

Some implementations described herein are directed to a sink system that includes a basin rail within the basin. The basin rail is configured to support a basin rail accessory within the basin. As a result, the basin rail accessory may be supported within the basin and suspended above a floor of the basin, by the basin rail.

Some implementations described herein are directed to a sink system that includes a basin shelf within the basin. The basin shelf is configured to fold out from, and back against, the basin. In this way, the basin shelf may be used to support items within the basin and then folded back against the basin when not in use.

Some implementations described herein are directed to a sink system that includes a basin deck that is configured to be supported within the basin by recesses formed in the basin. The basin deck may include magnetic couplers that facilitate attachment and retention of the basin deck and the basin.

Some implementations described herein are directed to a sink system that includes a basin rim with a rim deck that may be integrally formed with the basin. The rim deck includes supports that are configured to facilitate draining of water from items into the basin. The rim deck may be formed from a material that is different from the basin.

Some implementations described herein are directed to a sink system that includes a drain cover system. The drain cover system includes a drain cover that is operable between two different rotational positions. In one of the rotational positions, the drain cover sits flush against a floor and prohibits flow of water out of a drain. In another of the rotational positions, the drain cover may form a gap with a recess, the gap facilitating draining of water out of the drain.

II. Example Sink System

FIGS. 1-8 depict an example sink system 100 (e.g., kitchen sink system, counter sink system, etc.). As is explained in more detail herein, the sink system 100 includes one or more accessories that are configured to augment capabilities of a traditional sink, such that the sink system 100 is more desirable than a traditional sink. The accessories are selectively repositionable within a channel that is defined between a basin of the sink and an apron of the sink. The accessories can be inserted into the channel, repositioned within the channel, and removed from the channel, without the apron being removed from the basin. As a result, the sink system 100 eliminates the need for inelegant attachments to be attached to a sink.

The sink system 100 includes a basin 102. As is explained in more detail herein, the basin 102 is configured to receive water (e.g., hot water, cold water, potable water, cleaning water, etc.), facilitate use of the water within the basin 102, and provide the water from the basin 102. The basin 102 includes a floor 104 that includes a drain 106 formed therein. As is explained in more detail herein, the basin 102 is configured to provide water from a faucet 107 (e.g., kitchen faucet, etc.) to the drain 106, and the drain 106 is configured to pass water from the basin 102. The drain 106 is configured to be coupled to (e.g., attached to, joined with, integrally formed with, etc.) a sink drain conduit (e.g., pipe, fitting, disposal, etc.) and to provide water from the basin 102 to the sink drain conduit.

Figure 2:
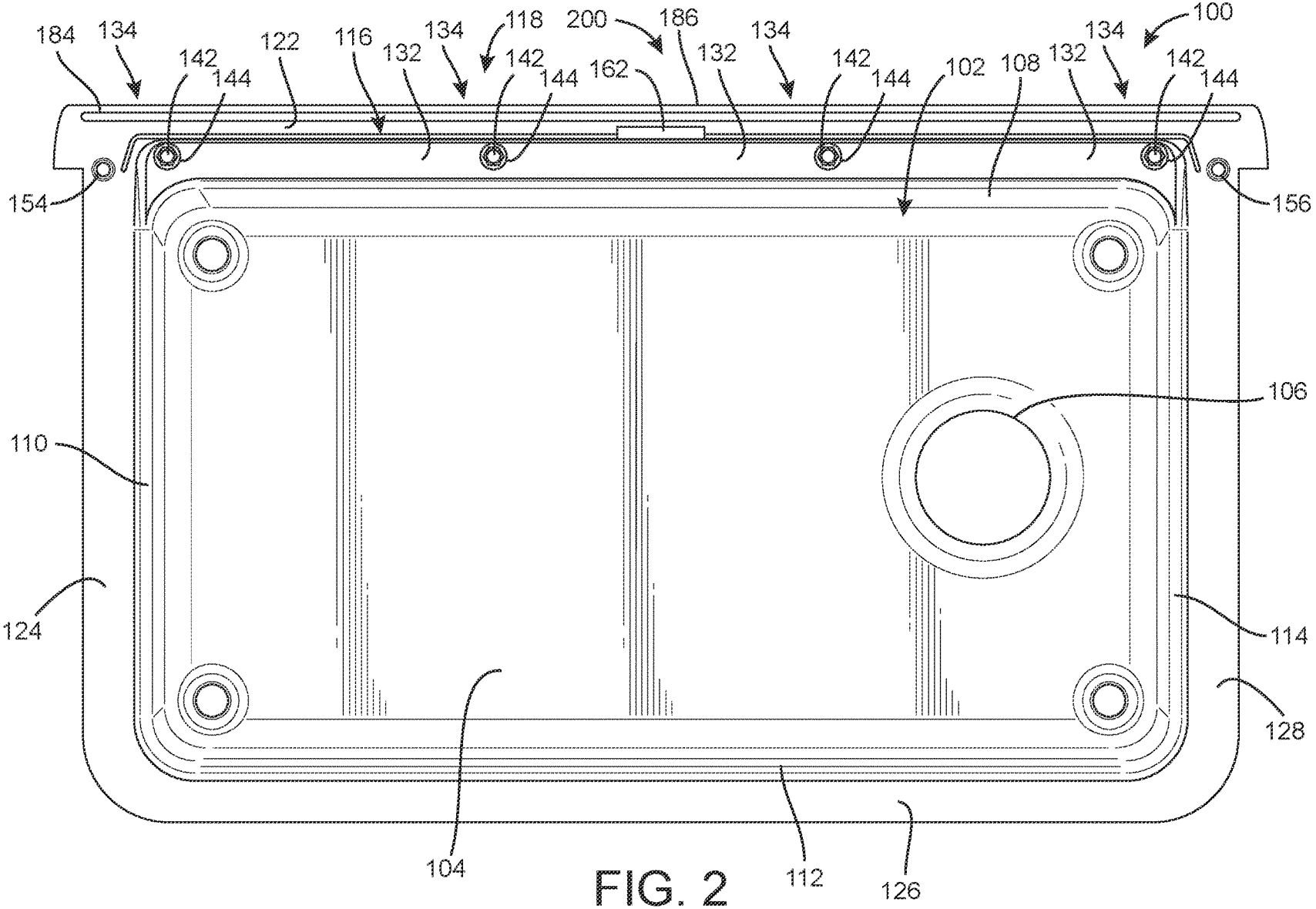
FIG. 2 is a bottom view of a basin for the sink system of FIG. 1.
Figure 3:
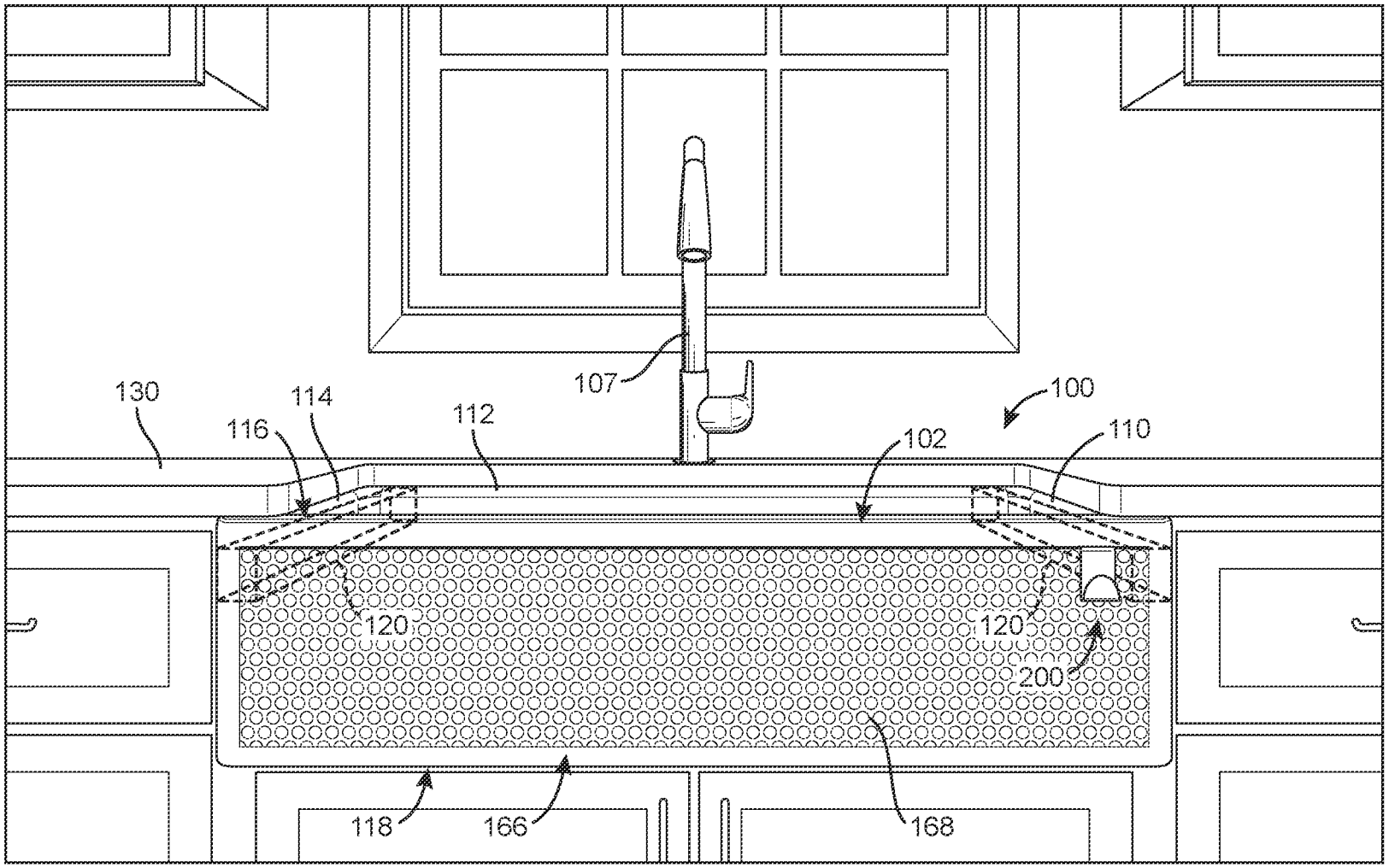
FIG. 3 is a front view of the sink system of FIG. 1 installed in a counter structure.
Figure 4:
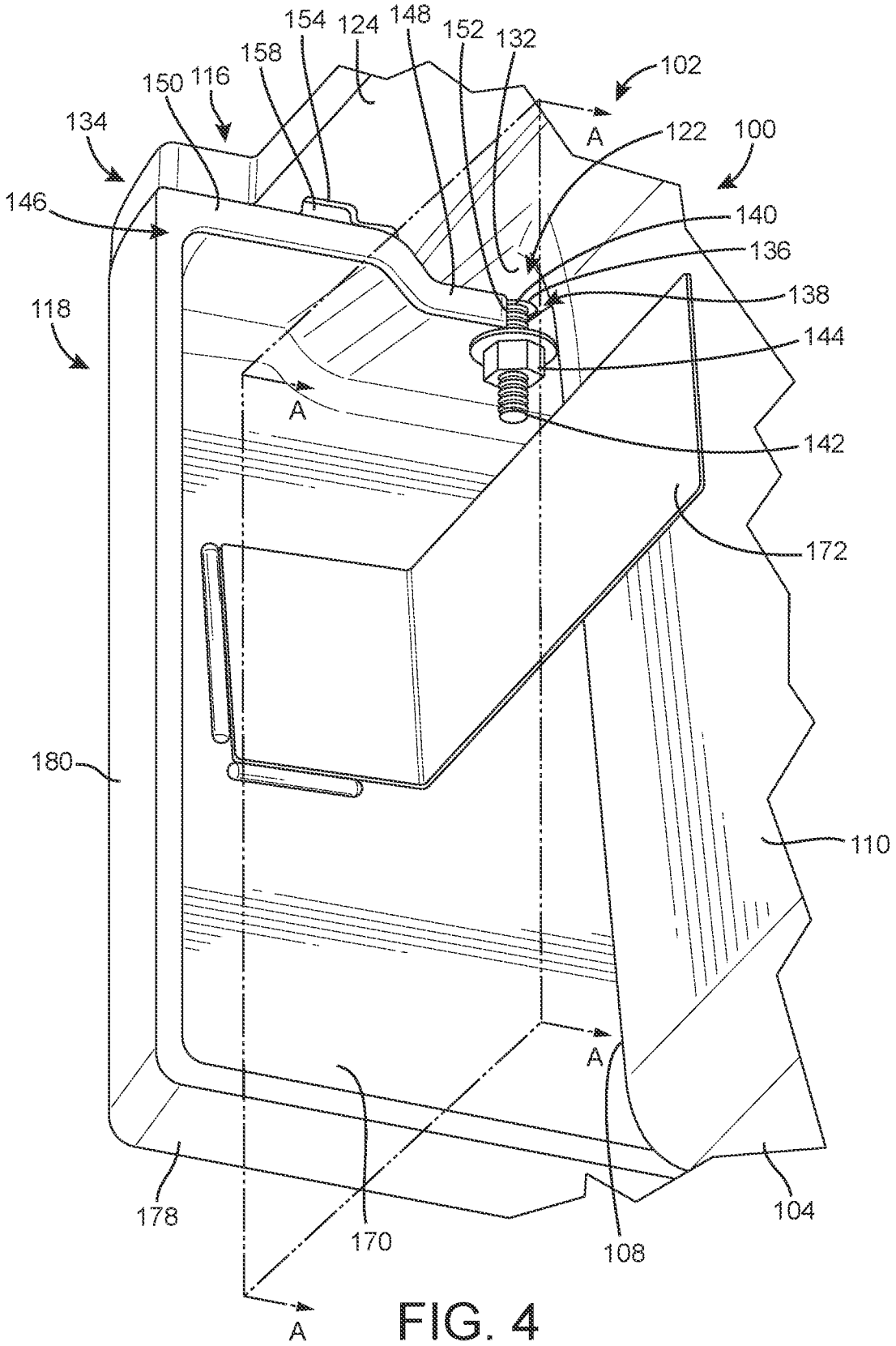
FIG. 4 is a rear perspective view of a portion of the sink system of FIG. 1.

Referring to FIG. 2, the basin 102 also includes a front wall 108. The front wall 108 is contiguous with (e.g., connected to, sharing a border with, extending from, etc.) the floor 104. The basin 102 also includes a first side wall 110. The first side wall 110 is contiguous with the floor 104 and the front wall 108. In some embodiments, the front wall 108 and the first side wall 110 are approximately (e.g., within 5% of, etc.) orthogonal.

The basin 102 also includes a rear wall 112. The rear wall 112 is contiguous with the floor 104 and the first side wall 110. In some embodiments, the front wall 108 and the rear wall 112 are approximately parallel.

The basin 102 also includes a second side wall 114. The second side wall 114 is contiguous with the floor 104, the front wall 108, and the rear wall 112. In some embodiments, the front wall 108 and the second side wall 114 are approximately orthogonal. In some embodiments, the rear wall 112 and the second side wall 114 are approximately orthogonal. In various embodiments, the front wall 108, the first side wall 110, the rear wall 112, and the second side wall 114 generally define a rectangle or a square.

The basin 102 also includes a basin rim 116. As is explained in more detail herein, the basin rim 116 facilitates attachment of the basin 102 to an apron 118 (e.g., skirt, panel, etc.) and support of the basin 102 on a counter structure 120 (e.g., support, beam, chassis, etc.).

The basin rim 116 includes a rim front side 122. The rim front side 122 is contiguous with the front wall 108 and extends (e.g., projects, protrudes, etc.) from the front wall 108 away from the rear wall 112. In various embodiments, the rim front side 122 is coupled to (e.g., attached to, fastened to, adhered to, etc.) the apron 118. In some embodiments, the rim front side 122 interfaces with the counter structure 120 (e.g., on a beam of the counter structure 120, etc.).

The basin rim 116 also includes a rim first side 124. The rim first side 124 is contiguous with the first side wall 110 and the rim front side 122. The rim first side 124 extends from the first side wall 110 away from the second side wall 114. In some embodiments, the rim first side 124 interfaces with the counter structure 120 (e.g., on a beam of the counter structure 120, etc.).

The basin rim 116 also includes a rim rear side 126. The rim rear side 126 is contiguous with the rear wall 112 and the rim first side 124 and extends from the rear wall 112 away from the front wall 108. In various embodiments, the rim rear side 126 is not coupled to the apron 118. In some embodiments, the rim rear side 126 interfaces with the counter structure 120 (e.g., on a beam of the counter structure 120, etc.).

The basin rim 116 also includes a rim second side 128. The rim second side 128 is contiguous with the second side wall 114, the rim rear side 126, and the rim front side 122. The rim second side 128 extends from the second side wall 114 away from the first side wall 110. In some embodiments, the rim second side 128 interfaces with the counter structure 120 (e.g., on a beam of the counter structure 120, etc.).

In some embodiments, at least a portion of the rim front side 122, at least a portion of the rim first side 124, at least a portion of the rim rear side 126, and at least a portion of the rim second side 128 are disposed along the same plane. In this way, the basin rim 116 may be positioned at a uniform distance from a counter 130 of the counter structure 120.

As shown in FIG. 2, the rim front side 122 includes a stepped portion 132 and a rim shelf 134. The rim shelf 134 partially surrounds (e.g., borders, etc.) the stepped portion 132. The stepped portion 132 is extended (e.g., protruded, projected, etc.) relative to the rim shelf 134. In other words, the stepped portion 132 is disposed along a plane that is separated from a plane along which the rim shelf 134 is disposed, and the plane along which the stepped portion 132 is disposed is closer to the floor 104 than the plane along which the rim shelf 134 is disposed.

The rim front side 122 includes a plurality of apertures 136 (e.g., holes, etc.) disposed in the stepped portion 132. For example, the rim front side 122 may include four apertures 136 uniformly distributed along the stepped portion 132 (e.g., an adjacent pair of the apertures 136 are separated from each other by a distance that is the same as a distance separating another adjacent pair of the apertures 136, etc.). In various embodiments, the apertures 136 are not through-holes. In other words, the apertures 136 do not extend entirely though the stepped portion 132. As a result, a top surface of the rim front side 122 (e.g., a surface of the rim front side 122 that is farthest from the floor 104, etc.) is uninterrupted across the apertures 136.

Figure 5:
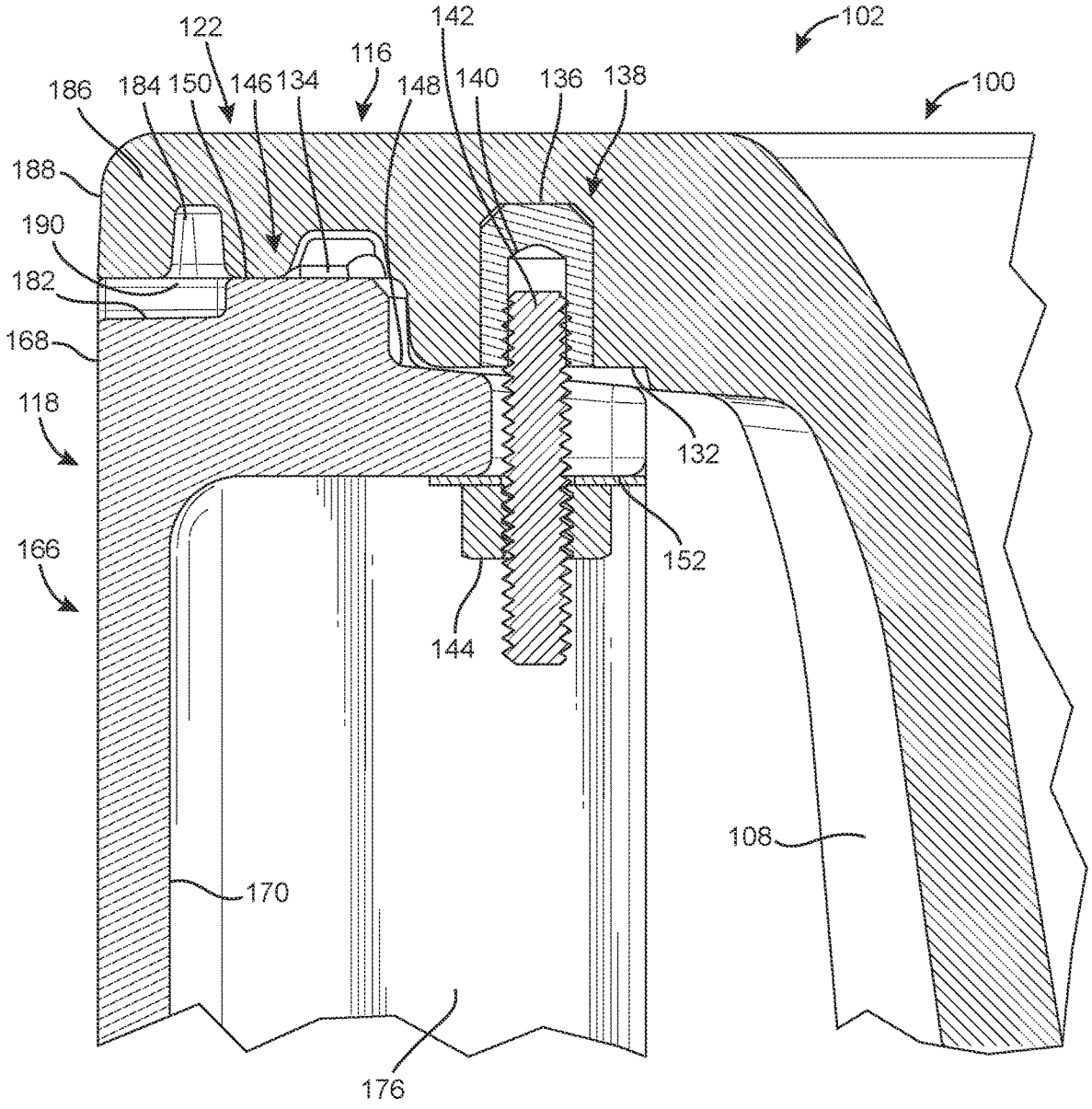
FIG. 5 is a cross-sectional view of the sink system shown in FIG. 4 taken along plane A-A.

As shown in FIG. 5, the sink system 100 also includes a plurality of basin rim inserts 138 (e.g., plugs, etc.). Each of the apertures 136 is configured to receive one of the basin rim inserts 138. For example, each of the basin rim inserts 138 may be press fit into one of the apertures 136. In some embodiments, adhesive is placed into the apertures 136 prior to the basin rim inserts 138 being inserted into the apertures 136. In these embodiments, the basin rim inserts 138 may be coupled to the stepped portion 132 via the adhesive and/or a friction fit between the basin rim inserts 138 and the apertures 136. In some embodiments, the basin rim inserts 138 are molded into the apertures 136. In some embodiments, the basin rim inserts 138 are integrally formed with the rim front side 122 (e.g., the rim front side 122 is molded around the basin rim inserts 138, etc.).

Each of the basin rim inserts 138 has an aperture 140 (e.g., hole, etc.). The apertures 140 are threaded. Each of the apertures 140 is configured to receive a threaded fastener 142 (e.g., bolt, etc.). The threaded fasteners 142 are configured to be coupled to the basin rim 116 via the apertures 140 without direct interfacing between the threaded fasteners 142 and the basin rim 116. As a result, mechanical stresses and strains on the basin rim 116 may be minimized. Each of the threaded fasteners 142 is configured to receive a nut 144. As is explained in more detail herein, the basin rim inserts 138, the threaded fasteners 142, and the nuts 144 cooperate to facilitate coupling of the apron 118 to the basin 102.

Figure 6:
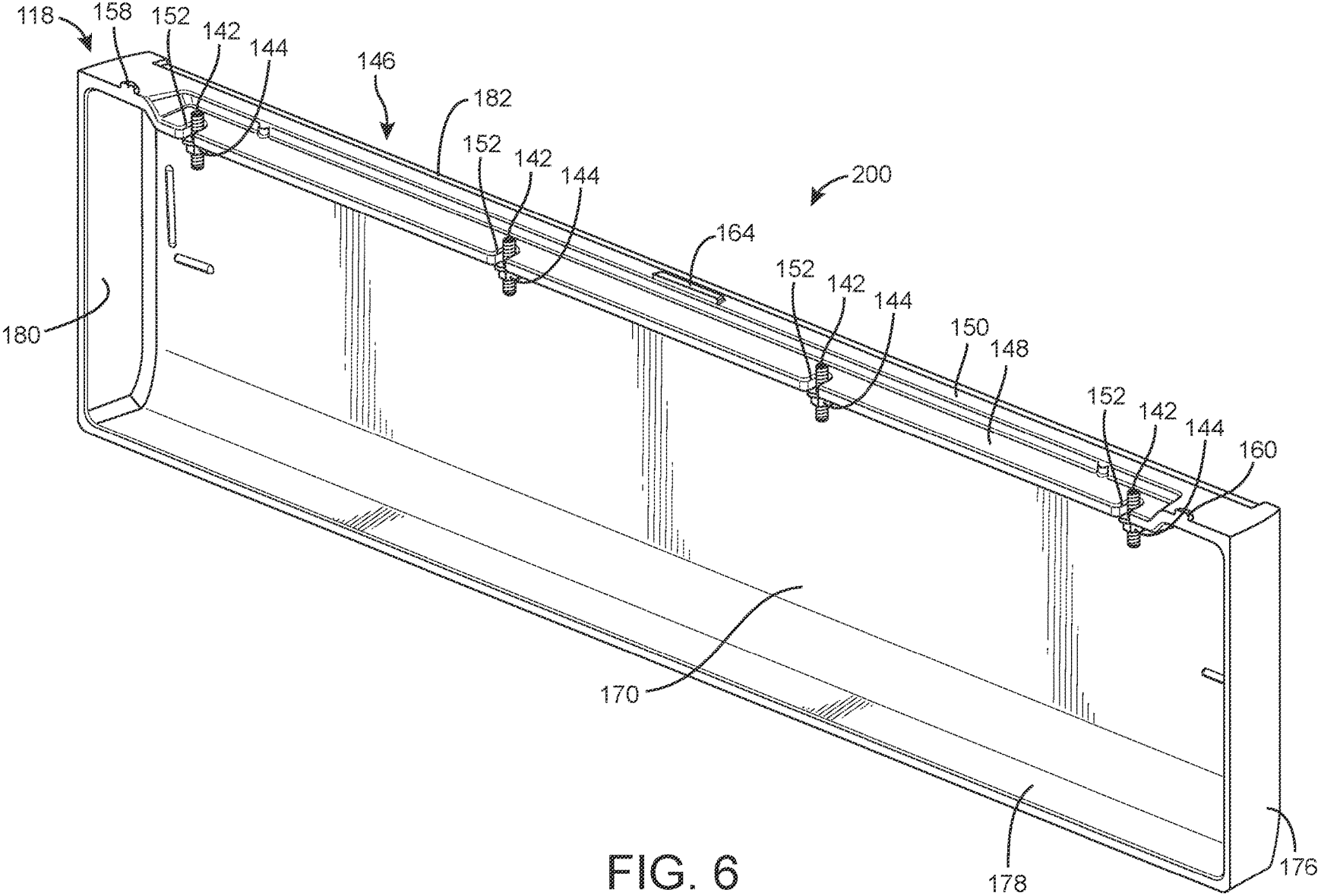
FIG. 6 is a rear perspective view of an apron for the sink system of FIG. 1.
Figure 7:
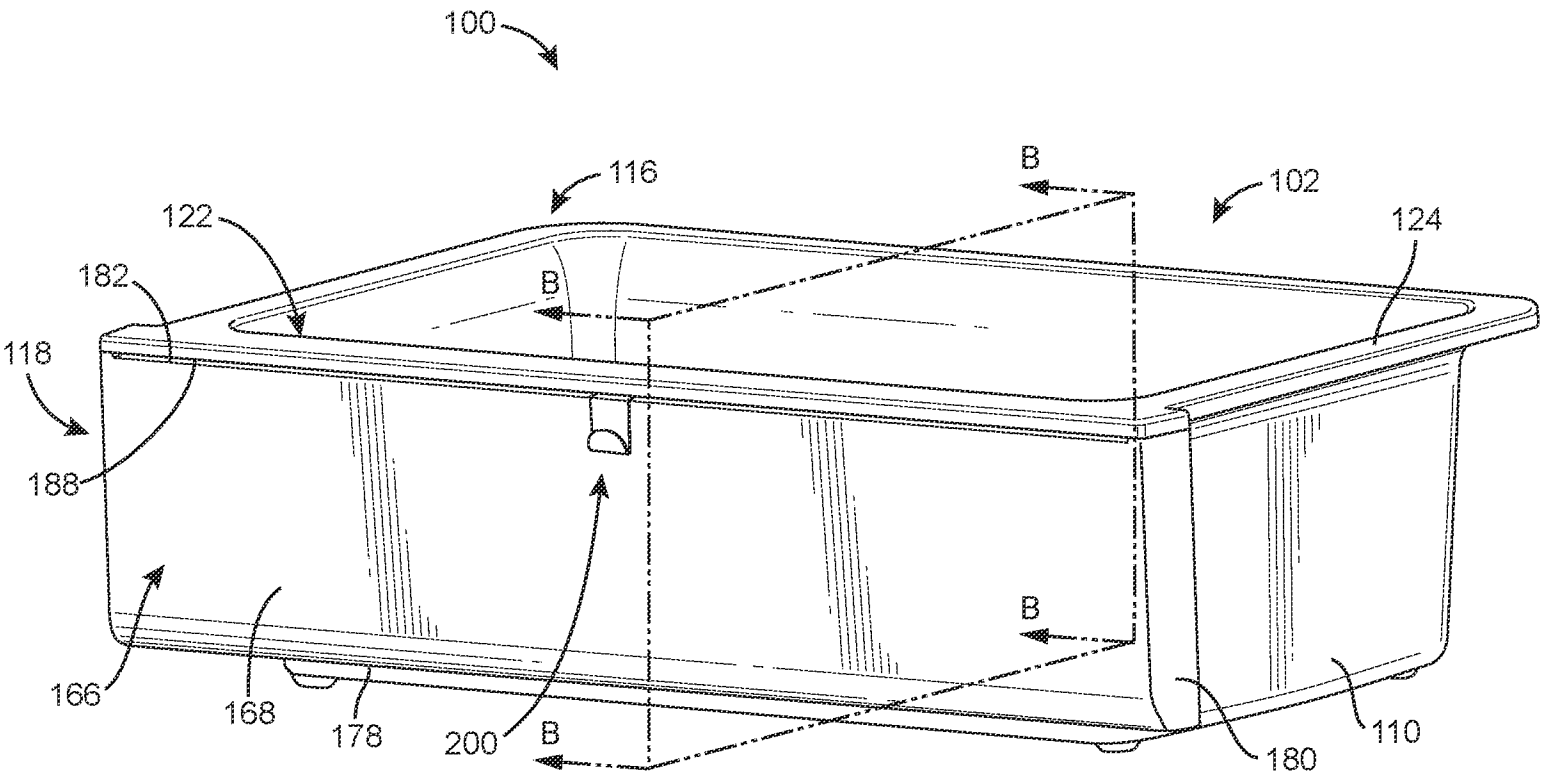
FIG. 7 is a front perspective view of a sink system according to another example embodiment.

As shown in FIG. 6, the apron 118 includes an apron coupling wall 146. As is explained in more detail herein, the apron coupling wall 146 is configured to facilitate coupling of the apron 118 to the basin 102. The apron coupling wall 146 includes an inner recessed portion 148 and an apron shelf 150. The apron shelf 150 partially surrounds the inner recessed portion 148. The inner recessed portion 148 is recessed relative to the apron shelf 150. In other words, the inner recessed portion 148 is disposed along a plane that is separated from a plane along which the apron shelf 150 is disposed, and the plane along which the inner recessed portion 148 is disposed is closer to the floor 104 than the plane along which the apron shelf 150 is disposed, when the apron 118 is coupled to the basin 102. When the apron 118 is coupled to the basin 102, at least a portion of the apron shelf 150 is separated from the front wall 108 by the inner recessed portion 148.

The inner recessed portion 148 is configured to receive the stepped portion 132 such that the apron shelf 150 interfaces with the rim shelf 134 when the stepped portion 132 is received within the inner recessed portion 148. The inner recessed portion 148 and the stepped portion 132 may both be chamfered, filleted, drafted, or otherwise shaped such that the inner recessed portion 148 is guided onto and over the stepped portion 132 when the apron 118 is lifted towards the basin 102 and subsequently coupled to the basin 102.

The inner recessed portion 148 includes a plurality of apron slots 152 (e.g., elongated holes, slits, etc.). Each of the apron slots 152 is configured to be aligned with one of the apertures 136 when the apron 118 is coupled to the basin 102. Furthermore, each of the apron slots 152 is configured to receive one of the threaded fasteners 142.

To couple the apron 118 to the basin 102, the basin rim inserts 138 are first inserted into the apertures 140. Next, the threaded fasteners 142 are threaded into the apertures 140. The apron 118 is then lifted and the apron slots 152 are aligned with the threaded fasteners 142, which are each extending from one of the apertures 136. The apron 118 is then translated towards the basin 102, such that the apron coupling wall 146 is located underneath and in confronting relation with the rim front side 122. This causes the stepped portion 132 to be received within the inner recessed portion 148, and for the rim shelf 134 to interface with the apron shelf 150. As a result, the threaded fasteners 142 are received within the apron slots 152. Finally, the nuts 144 are threaded onto the threaded fasteners 142 such that the apron coupling wall 146 is tightened against the rim front side 122. The apron slots 152 may facilitate adjustment of the apron 118 relative to the basin 102 (e.g., tilting of the apron coupling wall 146 relative to the rim front side 122, etc.) as the nuts 144 are being tightened.

In various embodiments, the rim front side 122 includes a first end recess 154 and a second end recess 156. The first end recess 154 and the second end recess 156 are both disposed in the rim shelf 134. The first end recess 154 is located proximate the rim first side 124 and the second end recess 156 is located proximate the rim second side 128. In these embodiments, the apron coupling wall 146 includes a first end projection 158 and a second end projection 160. The first end projection 158 and the second end projection 160 are both disposed in the apron shelf 150. The first end recess 154 is configured to receive the first end projection 158 when the rim shelf 134 interfaces with the apron shelf 150. Similarly, the second end recess 156 is configured to receive the second end projection 160 when the rim shelf 134 interfaces with the apron shelf 150. When the apron 118 is not desirably aligned with the basin 102, the first end projection 158 may interface with the rim shelf 134 and/or the second end projection 160 may interface with the rim shelf 134. In this way, the first end recess 154, the second end recess 156, the first end projection 158, and the second end projection 160 cooperate to decrease a likelihood of the apron 118 being coupling to the basin 102 when the apron 118 is not desirably aligned with the basin 102. In various embodiments, the first end recess 154 and the second end recess 156 are not through-holes. In other words, the first end recess 154 and the second end recess 156 do not extend entirely though the rim shelf 134. As a result, a top surface of the rim front side 122 (e.g., a surface of the rim front side 122 that is farthest from the floor 104, etc.) is uninterrupted across the rim front side 122.

In various embodiments, the rim front side 122 includes a central recess 162. The central recess 162 is disposed in the rim shelf 134. The central recess 162 is located proximate a midpoint of the rim front side 122 (e.g., at an approximately equal distance from the rim first side 124 and the rim second side 128, etc.). In these embodiments, the apron coupling wall 146 includes a central projection 164. The central projection 164 is disposed in the apron shelf 150. The central recess 162 is configured to receive the central projection 164 when the rim shelf 134 interfaces with the apron shelf 150. When the apron 118 is not desirably aligned with the basin 102, the central projection 164 may interface with the rim shelf 134. In this way, the central recess 162 and the central projection 164 cooperate to decrease a likelihood of the apron 118 being coupling to the basin 102 when the apron 118 is not desirably aligned with the basin 102. In various embodiments, the central recess 162 is not a through-hole. In other words, the central recess 162 does not extend entirely though the rim shelf 134. As a result, a top surface of the rim front side 122 (e.g., a surface of the rim front side 122 that is farthest from the floor 104, etc.) is uninterrupted across the central recess 162.

In some embodiments, the rim front side 122 includes the first end recess 154, the second end recess 156, and the central recess 162, and the apron coupling wall 146 includes the first end projection 158, the second end projection 160, and the central projection 164.

The apron 118 also includes an apron panel wall 166. The apron panel wall 166 is contiguous with the apron coupling wall 146. The apron panel wall 166 extends from the apron coupling wall 146 away from the rim front side 122. The apron panel wall 166 defines an exterior surface 168 (e.g., face, etc.) and an interior surface 170 (e.g., face, etc.).

The exterior surface 168 has a target aesthetic appearance. For example, the exterior surface 168 may be textured, polished, and/or contain a design or image. In this way, the exterior surface 168 may provide a desired aesthetic benefit to a room within which the sink system 100 is installed. Advantageously, the sink system 100 is configured such that the apron 118 having an exterior surface 168 with a first target aesthetic appearance can be rapidly and easily interchanged with another apron 118 having an exterior surface 168 with a second target aesthetic appearance, while utilizing the same basin 102 and the same other components of the sink system 100. Additionally, the basin 102 can remain supported by the counter structure 120 while the apron 118 coupled to the basin 102 is uncoupled from the basin 102, and a new apron 118 is coupled to the basin 102. In this way, a user can rapidly and easily provide a desired aesthetic benefit to a room within which the sink system 100 is installed.

In various embodiments, the sink system 100 also includes a first coupling bracket 172 and a second coupling bracket 174. The first coupling bracket 172 is coupled to the first side wall 110 and the interior surface 170. Similarly, the second coupling bracket 174 is coupled to the second side wall 114 and the interior surface 170. Collectively, the first coupling bracket 172 and the second coupling bracket 174 aid in securing the apron 118 to the basin 102.

The apron 118 also includes a first connector wall 176. The first connector wall 176 is contiguous with the apron coupling wall 146 and the apron panel wall 166. The first connector wall 176 extends from the apron coupling wall 146 away from the rim front side 122 and from the apron panel wall 166 towards the front wall 108.

The apron 118 also includes an apron spanning wall 178. The apron spanning wall 178 is contiguous with the apron panel wall 166 and the first connector wall 176. The apron spanning wall 178 extends from the apron panel wall 166 towards the front wall 108 and from the first connector wall 176 away from the second side wall 114.

The apron 118 also includes a second connector wall 180. The second connector wall 180 is contiguous with the apron coupling wall 146, the apron panel wall 166, and the apron spanning wall 178. The second connector wall 180 extends from the apron coupling wall 146 away from the rim front side 122 and from the apron panel wall 166 towards the front wall 108.

III. Example Sink System with Apron Attachment

In various embodiments, the apron coupling wall 146 includes an outer recessed portion 182. The outer recessed portion 182 is partially surrounded by the apron shelf 150. Additionally, the outer recessed portion 182 is separated from the inner recessed portion 148 by the apron shelf 150. In embodiments where the apron coupling wall 146 includes the central projection 164, the central projection 164 is disposed on the apron shelf 150 between the outer recessed portion 182 and the inner recessed portion 148.

The outer recessed portion 182 is recessed relative to the apron shelf 150. In other words, the outer recessed portion 182 is disposed along a plane that is separated from a plane along which the apron shelf 150 is disposed, and the plane along which the outer recessed portion 182 is disposed is closer to the floor 104 than the plane along which the apron shelf 150 is disposed, when the apron 118 is coupled to the basin 102. Similarly, the plane along which the outer recessed portion 182 is disposed is closer to the apron spanning wall 178 than the plane along which the apron shelf 150 is disposed. The outer recessed portion 182 is contiguous with the exterior surface 168.

The rim shelf 134 includes an attachment recess 184. The attachment recess 184 is disposed along a straight line and is configured to be aligned with the outer recessed portion 182 when the apron 118 is coupled to the basin 102. In embodiments where the rim front side 122 includes the central recess 162, the central recess 162 is disposed on the rim front side 122 between the attachment recess 184 and the stepped portion 132.

The attachment recess 184 extends through the rim shelf 134 such that a lip 186 of the rim shelf 134 is formed between the attachment recess 184 and an exterior surface 188 of the rim front side 122. The attachment recess 184 is recessed relative to the rim shelf 134. In other words, the attachment recess 184 is disposed along a plane that is separated from a plane along which the rim shelf 134 is disposed, and the plane along which the attachment recess 184 is further from the floor 104 than the plane along which the rim shelf 134 is disposed.

When the apron 118 is coupled to the basin 102, the attachment recess 184 is aligned with the outer recessed portion 182. Collectively, the attachment recess 184 and the outer recessed portion 182 form an apron attachment channel 190 when the apron 118 is coupled to the basin 102. The apron attachment channel 190 is generally L-shaped or includes at least an L-shape.

As shown in FIGS. 2, 3, and 6-8, the sink system 100 also includes an apron attachment 200. The apron attachment 200 is configured to be received within the apron attachment channel 190 such that the apron attachment is secured within the apron attachment channel 190. The apron attachment 200 is also configured to be removed from the apron attachment channel 190. Advantageously, the sink system 100 is configured such that the apron attachment 200 can be received within, and removed from, the apron attachment channel 190 without uncoupling the apron 118 from the basin 102. As is explained in more detail herein, the apron attachment 200 provides additional functionality to the sink system 100, thereby increasing the desirability of the sink system 100.

The apron attachment 200 includes an apron attachment coupler 202 and an apron attachment accessory 204. The apron attachment coupler 202 is configured to be received within, and removed from, the apron attachment channel 190.

The apron attachment coupler 202 includes a retainer portion 206 and a connector portion 208. The retainer portion 206 and the connector portion 208 are each configured to be received within the apron attachment channel 190. The connector portion 208 is contiguous with the retainer portion 206 and separates the apron attachment accessory 204 from the retainer portion 206. The connector portion 208 extends from the apron attachment channel 190 when the retainer portion 206 is received within the apron attachment channel 190.

Figure 8:
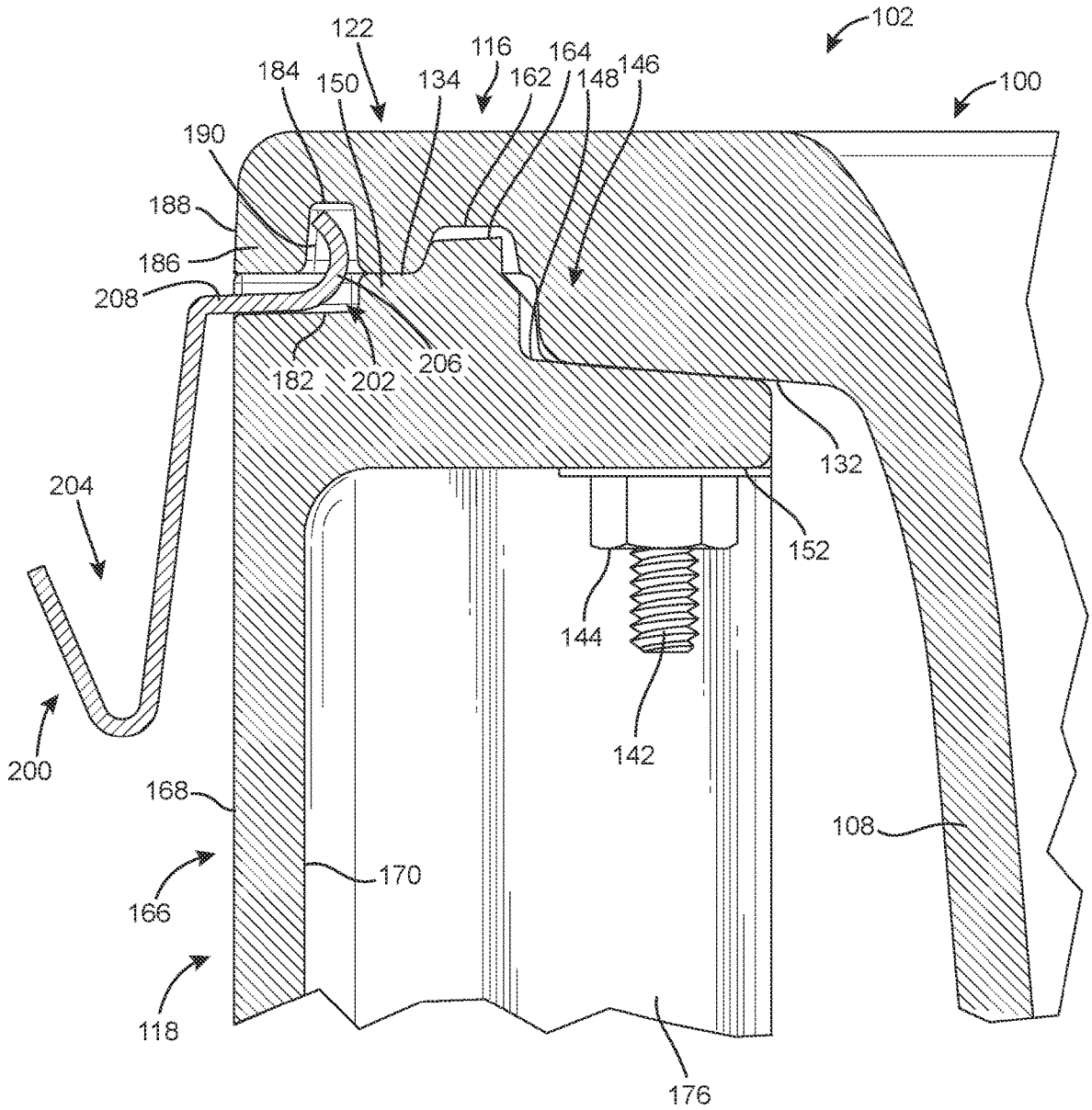
FIG. 8 is a cross-sectional view of the sink system shown in FIG. 7 taken along plane B-B.
Figure 9:
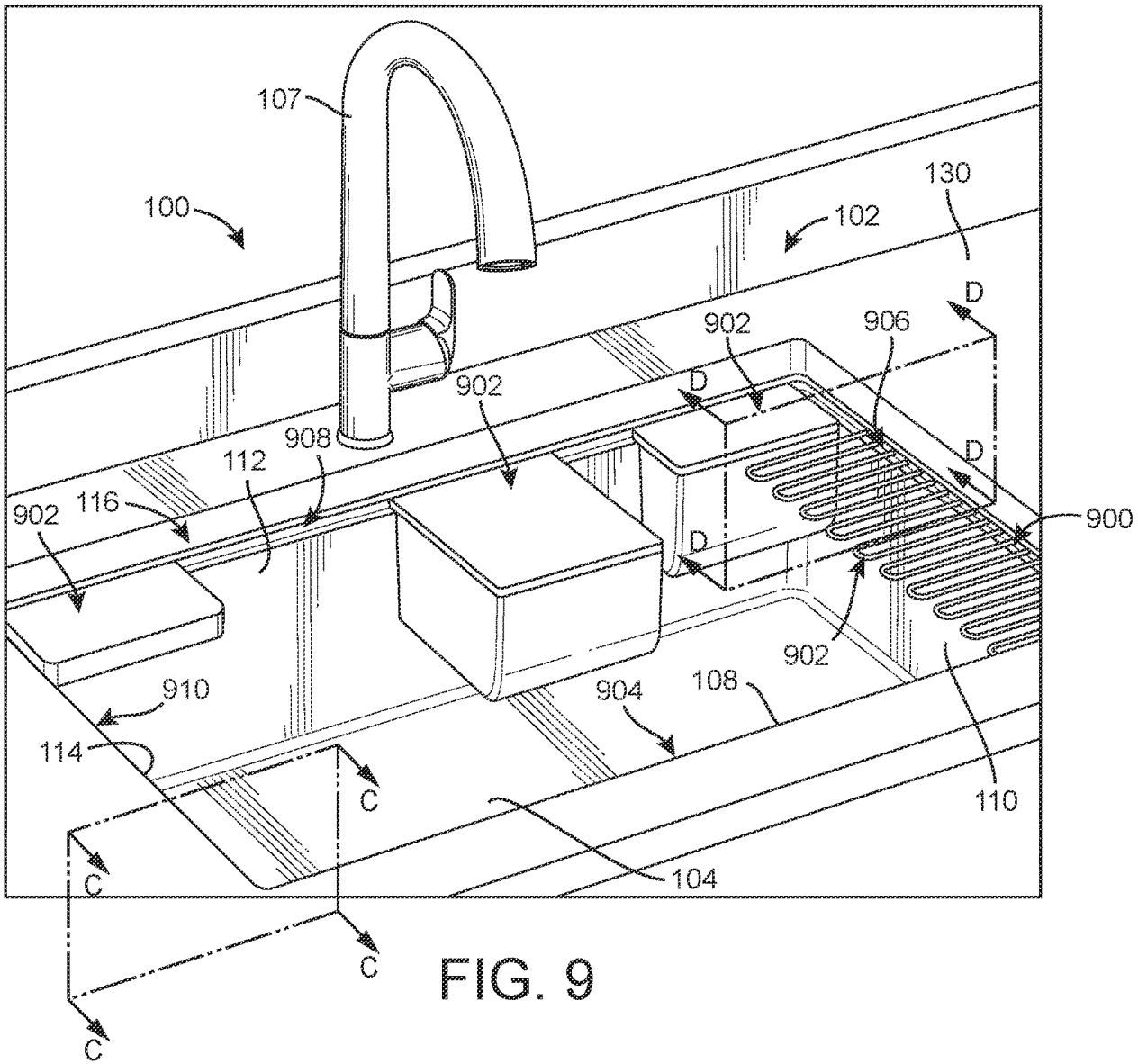
FIG. 9 is a top perspective view of a sink system according to another example embodiment.

As shown in FIG. 8, the retainer portion 206 is at least partially disposed within the attachment recess 184 when the apron attachment 200 is secured within the apron attachment channel 190. As a result, movement of the apron attachment 200 (e.g., towards the exterior surface 168, away from the exterior surface 168, etc.) may cause the retainer portion 206 to be biased against the lip 186 and/or the rim shelf 134.

Contact between the retainer portion 206 and the lip 186 may limit or resist movement of the retainer portion 206, and therefore movement of the connector portion 208 and the apron attachment accessory 204 (e.g., relative to the exterior surface 168, etc.). Similarly, contact between the retainer portion 206 and rim shelf 134 may limit or resist movement of the retainer portion 206, and therefore movement of the connector portion 208 and the apron attachment accessory 204 (e.g., relative to the exterior surface 168, etc.).

When the apron attachment 200 is secured within the apron attachment channel 190, the connector portion 208 extends between the lip 186 and the outer recessed portion 182. In various embodiments, the apron attachment channel 190 is configured such that the apron attachment 200 can be selectively repositioned (e.g., slid, etc.) along the apron attachment channel 190 (e.g., from a position proximate the first connector wall 176 to a position proximate the second connector wall 180, etc.).

To secure the apron attachment 200 to the apron attachment channel 190, the retainer portion 206 is first inserted between the lip 186 and the outer recessed portion 182. Then, the apron attachment 200 is rotated and the retainer portion 206 is inserted into the attachment recess 184 and between the lip 186 and the rim shelf 134. This insertion of the outer recessed portion 182 subsequently causes an insertion of the connector portion 208 between the lip 186 and the outer recessed portion 182.

In various embodiments, the apron attachment accessory 204 is a towel holder (e.g., hook, ring, stud, etc.). In other embodiments, the apron attachment accessory 204 is a sponge or brush holder (e.g., container, cup, tray, etc.). In still other embodiments, the apron attachment accessory 204 is a mobile device (e.g., cell phone, smart phone, etc.) holder.

In various embodiments, a portion of the outer recessed portion 182 is disposed closer to the first connector wall 176 than the attachment recess 184 and/or a portion of the outer recessed portion 182 is disposed closer to the second connector wall 180 than the attachment recess 184. As a result, the apron attachment 200 can be secured to the apron attachment channel 190 by sliding the retainer portion 206 and the connector portion 208 into the apron attachment channel 190 (e.g., towards the first connector wall 176, towards the second connector wall 180, etc.).

IV. Example Sink System with Basin Channel and Basin Accessory

FIGS. 9-12 illustrate portions of the sink system 100 according to various embodiments. The sink system 100 includes a basin channel which enables coupling a basin accessory within the basin such that the basin accessory is suspended above the floor of the basin. In this way, accessories may be attached within the basin. As a result, counter space is preserved and the accessories are held above water resting on the floor of the basin.

The basin 102 includes at least one basin channel 900. As is explained in more detail herein, the sink system 100 also includes one or more basin accessories 902 that is configured to be secured to the basin channel 900 and removed from the basin channel 900 without any modification to the basin 102. As is explained in more detail herein, the basin accessory 902 provides additional functionality to the sink system 100, thereby increasing the desirability of the sink system 100. Additionally, because the basin accessory 902 is secured to the basin channel 900 only via a connection at the basin channel 900, the basin accessory 902 is suspended above the floor 104. This suspension may make the basin accessory 902 more desirable than other basin accessories which rest on a countertop, and therefore take up counter space, or rest on a sink bottom, and therefore take up sink space (e.g., larger items are unable to rest on the sink bottom, etc.) and/or accumulate grime due to water present on the sink bottom.

The basin channel 900 includes a first portion 904. The first portion 904 is formed in the front wall 108, in the rim front side 122, or between the front wall 108 and the rim front side 122. Additionally, the first portion 904 extends across at least a portion of the front wall 108 and/or at least a portion of the rim front side 122.

The basin channel 900 also includes a second portion 906. The second portion 906 is formed in the first side wall 110, in the rim first side 124, or between the first side wall 110 and the rim first side 124. Additionally, the second portion 906 extends across at least a portion of the first side wall 110 and/or at least a portion of the rim first side 124.

The basin channel 900 also includes a third portion 908. The third portion 908 is formed in the rear wall 112, in the rim rear side 126, or between the rear wall 112 and the rim rear side 126. Additionally, the third portion 908 extends across at least a portion of the rear wall 112 and/or at least a portion of the rim rear side 126.

The basin channel 900 also includes a fourth portion 910. The fourth portion 910 is formed in the second side wall 114, in the rim second side 128, or between the second side wall 114 and the rim second side 128. Additionally, the fourth portion 910 extends across at least a portion of the second side wall 114 and/or at least a portion of the rim second side 128.

In various embodiments, the first portion 904 is contiguous with both the second portion 906 and the fourth portion 910, and the third portion 908 is contiguous with both the second portion 906 and the fourth portion 910. In these embodiments, the basin channel 900 extends continuously within the basin 102 and across the front wall 108, the first side wall 110, the rear wall 112, and the second side wall 114. As a result, the basin accessory 902 may be secured within the basin 102 at any location along the front wall 108, the first side wall 110, the rear wall 112, and the second side wall 114.

Figure 10:
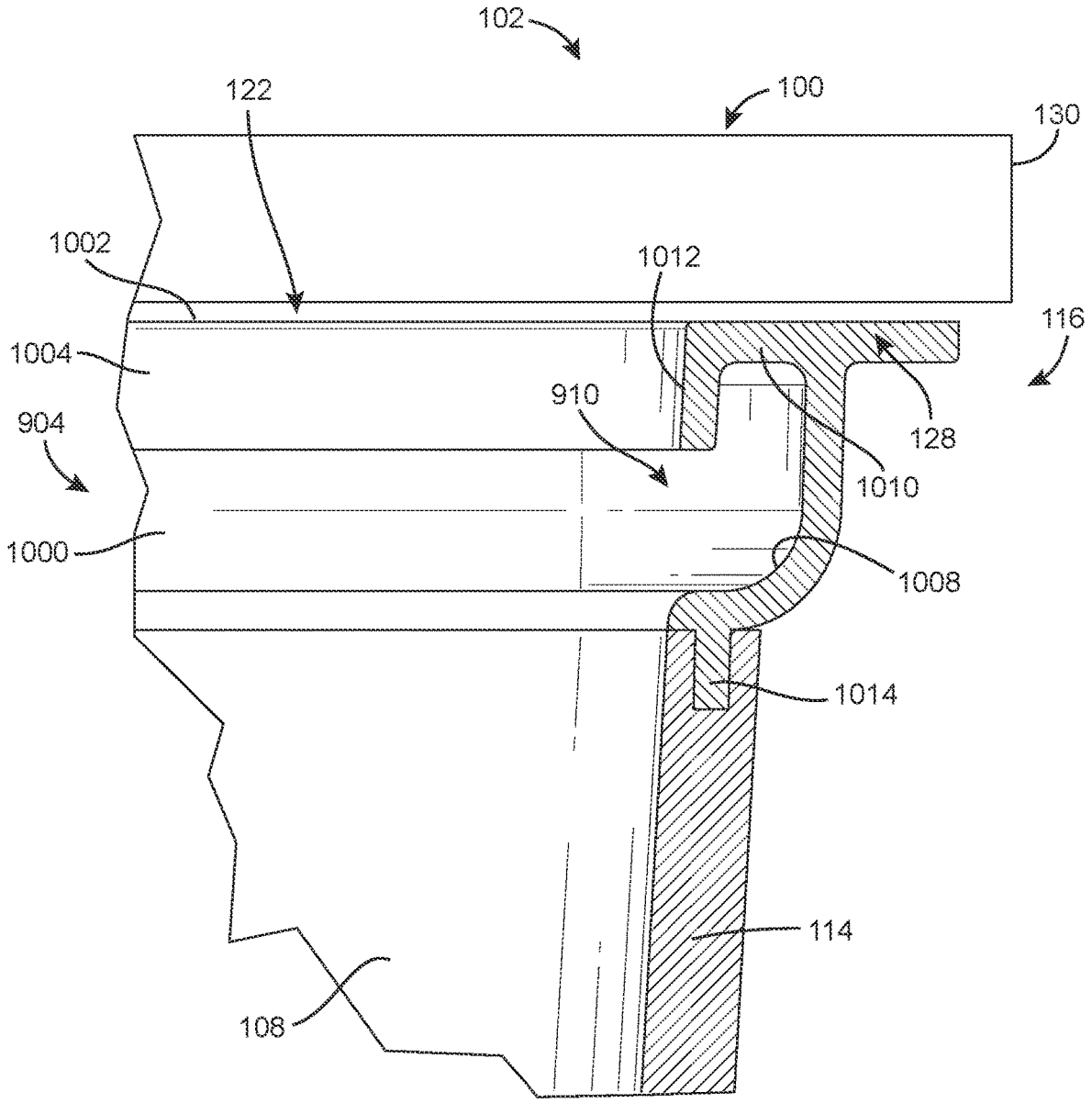
FIG. 10 is a cross-sectional view of the sink system shown in FIG. 9 taken along plane C-C.

As shown in FIG. 10, the first portion 904 is formed in the rim front side 122 and the fourth portion 910 is formed in the rim second side 128.

The rim front side 122 includes a wall 1000. The wall 1000 is contiguous with the first portion 904. As is explained in more detail herein, the wall 1000 is generally curved and/or sloped towards the floor 104 so as to facilitate draining (e.g., due to gravity, etc.) of water from the first portion 904 to the drain 106. In this way, first portion 904 can be easily cleaned by a user.

The rim front side 122 also includes a wall 1002. The wall 1002 is contiguous with the both the first portion 904 and the wall 1000. In some embodiments, the wall 1002 is disposed along a plane that is approximately parallel to the counter 130.

The rim front side 122 also includes a lip wall 1004. The lip wall 1004 is contiguous with the both the first portion 904 and the wall 1002. The lip wall 1004 is separated from the wall 1000 by the wall 1002. In some embodiments, the lip wall 1004 is disposed along a plane that is approximately orthogonal to the counter 130 and/or is approximately orthogonal to the wall 1002.

Collectively, the wall 1000, the wall 1002, and the lip wall 1004 define the first portion 904. In various embodiments, the wall 1000, the wall 1002, and the lip wall 1004 are structured such that the first portion 904 has a generally J-shaped cross-sectional shape or a generally L-shaped cross-sectional shape.

In some embodiments, the wall 1000 is coupled to the front wall 108. In other embodiments, the rim front side 122 also includes a rim front side joint wall that is contiguous with the wall 1000. In these embodiments, the rim front side joint wall is coupled to the front wall 108.

While the wall 1000, the wall 1002, and the lip wall 1004 are described as being part of the rim front side 122, it is understood that the wall 1000, the wall 1002, and the lip wall 1004 could similarly be partially or completely integrated within the front wall 108 in a similar fashion.

The rim second side 128 includes a wall 1008. The wall 1008 is contiguous with the fourth portion 910. As is explained in more detail herein, the wall 1008 is generally curved and/or sloped towards the floor 104 so as to facilitate draining (e.g., due to gravity, etc.) of water from the fourth portion 910 to the drain 106. In this way, fourth portion 910 can be easily cleaned by a user.

The rim second side 128 also includes a wall 1010. The wall 1010 is contiguous with the both the fourth portion 910 and the wall 1008. In some embodiments, the wall 1010 is disposed along a plane that is approximately parallel to the counter 130.

The rim second side 128 also includes a lip wall 1012. The lip wall 1012 is contiguous with the both the fourth portion 910 and the wall 1010. The lip wall 1012 is separated from the wall 1008 by the wall 1010. In some embodiments, the lip wall 1012 is disposed along a plane that is approximately orthogonal to the counter 130 and/or is approximately orthogonal to the wall 1010.

Collectively, the wall 1008, the wall 1010, and the lip wall 1012 define the fourth portion 910. In various embodiments, the wall 1008, the wall 1010, and the lip wall 1012 are structured such that the fourth portion 910 has a generally J-shaped cross-sectional shape or a generally L-shaped cross-sectional shape.

In some embodiments, the wall 1008 is coupled to the second side wall 114. In other embodiments, the rim second side 128 also includes a joint wall 1014 wall that is contiguous with the wall 1008. In these embodiments, the joint wall 1014 is coupled to the second side wall 114.

While the wall 1008, the wall 1010, and the lip wall 1012 are described as being part of the rim second side 128, it is understood that the wall 1008, the wall 1010, and the lip wall 1012 could similarly be partially or completely integrated within the second side wall 114 in a similar fashion.

Figure 11:
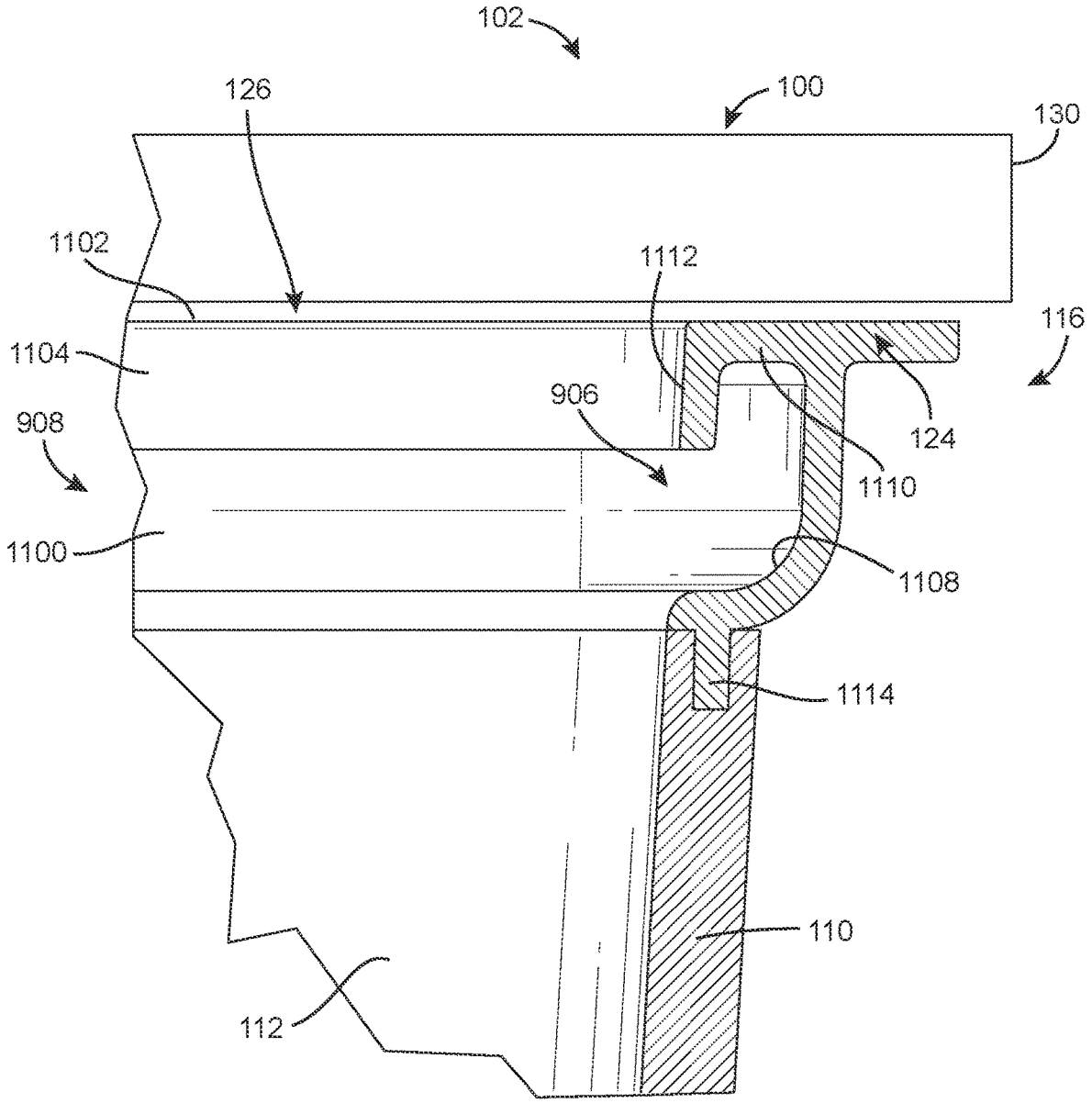
FIG. 11 is a cross-sectional view of the sink system shown in FIG. 9 taken along plane D-D.

As shown in FIG. 11, the third portion 908 is formed in the rim rear side 126 and the second portion 906 is formed in the rim first side 124.

The rim rear side 126 includes a channel wall 1100. The channel wall 1100 is contiguous with the third portion 908. As is explained in more detail herein, the channel wall 1100 is generally curved and/or sloped towards the floor 104 so as to facilitate draining (e.g., due to gravity, etc.) of water from the third portion 908 to the drain 106. In this way, the third portion 908 can be easily cleaned by a user.

The rim rear side 126 also includes a rim wall 1102. The rim wall 1102 is contiguous with the both the third portion 908 and the channel wall 1100. In some embodiments, the rim wall 1102 is disposed along a plane that is approximately parallel to the counter 130.

The rim rear side 126 also includes a lip wall 1104. The lip wall 1104 is contiguous with the both the third portion 908 and the rim wall 1102. The lip wall 1104 is separated from the channel wall 1100 by the rim wall 1102. In some embodiments, the lip wall 1104 is disposed along a plane that is approximately orthogonal to the counter 130 and/or is approximately orthogonal to the rim wall 1102.

Collectively, the channel wall 1100, the rim wall 1102, and the lip wall 1104 define the third portion 908. In various embodiments, the channel wall 1100, the rim wall 1102, and the lip wall 1104 are structured such that the third portion 908 has a generally J-shaped cross-sectional shape or a generally L-shaped cross-sectional shape.

In some embodiments, the channel wall 1100 is coupled to the rear wall 112. In other embodiments, the rim rear side 126 also includes a rim rear side joint wall that is contiguous with the channel wall 1100. In these embodiments, the rim rear side joint wall is coupled to the rear wall 112.

While the channel wall 1100, the rim wall 1102, and the lip wall 1104 are described as being part of the rim rear side 126, it is understood that the channel wall 1100, the rim wall 1102, and the lip wall 1104 could similarly be partially or completely integrated within the rear wall 112 in a similar fashion.

The rim first side 124 includes a channel wall 1108. The channel wall 1108 is contiguous with the second portion 906. As is explained in more detail herein, the channel wall 1108 is generally curved and/or sloped towards the floor 104 so as to facilitate draining (e.g., due to gravity, etc.) of water from the second portion 906 to the drain 106. In this way, the second portion 906 can be easily cleaned by a user.

The rim first side 124 also includes a rim wall 1110. The rim wall 1110 is contiguous with the both the second portion 906 and the channel wall 1108. In some embodiments, the rim wall 1110 is disposed along a plane that is approximately parallel to the counter 130.

The rim first side 124 also includes a lip wall 1112. The lip wall 1112 is contiguous with the both the second portion 906 and the rim wall 1110. The lip wall 1112 is separated from the channel wall 1108 by the rim wall 1110. In some embodiments, the lip wall 1112 is disposed along a plane that is approximately orthogonal to the counter 130 and/or is approximately orthogonal to the rim wall 1110.

Collectively, the channel wall 1108, the rim wall 1110, and the lip wall 1112 define the second portion 906. In various embodiments, the channel wall 1108, the rim wall 1110, and the lip wall 1112 are structured such that the second portion 906 has a generally J-shaped cross-sectional shape or a generally L-shaped cross-sectional shape.

In some embodiments, the channel wall 1108 is coupled to the first side wall 110. In other embodiments, the rim first side 124 also includes a joint wall 1114 wall that is contiguous with the channel wall 1108. In these embodiments, the joint wall 1114 is coupled to the first side wall 110.

While the channel wall 1108, the rim wall 1110, and the lip wall 1112 are described as being part of the rim first side 124, it is understood that the channel wall 1108, the rim wall 1110, and the lip wall 1112 could similarly be partially or completely integrated within the first side wall 110 in a similar fashion.

Figure 12:
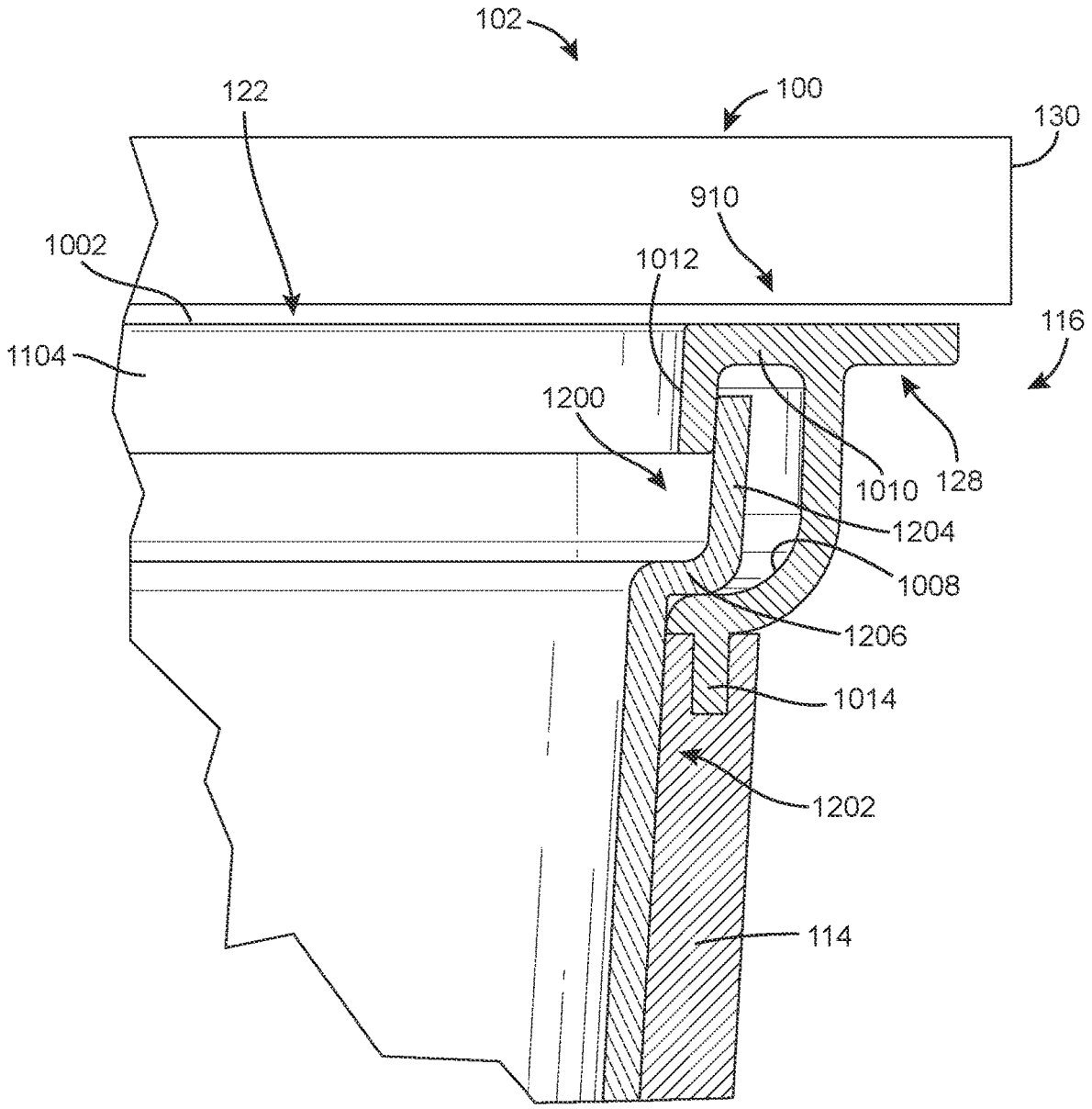
FIG. 12 is another cross-sectional view of the sink system shown in FIG. 9 taken along plane C-C.

As shown in FIG. 12, the basin accessory 902 is secured to the first portion 904 and the fourth portion 910. However, it is understood that the basin accessory 902 could be similarly secured to any of the first portion 904, the second portion 906, the third portion 908, and/or the fourth portion 910, alone or in combination. Similar to the apron attachment 200, the basin accessory 902 includes a basin accessory coupler 1200 and a basin accessory 1202. The basin accessory coupler 1200 is configured to be received within, and removed from, the basin channel 900.

The basin accessory coupler 1200 includes a retainer portion 1204 and a connector portion 1206. The retainer portion 1204 and the connector portion 1206 are each configured to be received within the basin channel 900. The connector portion 1206 is contiguous with the retainer portion 1204 and separates the basin accessory 1202 from the retainer portion 1204. The connector portion 1206 extends from the basin channel 900 when the retainer portion 1204 is received within the basin channel 900.

FIG. 12 illustrates the retainer portion 1204 at least partially disposed within the first portion 904 and at least partially disposed within the fourth portion 910. As a result, movement of the basin accessory 902 (e.g., towards the front wall 108, away from the front wall 108, towards the second side wall 114, away from the second side wall 114, etc.) may cause the retainer portion 1204 to be biased against the wall 1000, the lip wall 1004, the wall 1008, and/or the lip wall 1012.

Contact between the retainer portion 1204 and the wall 1000 may limit or resist movement of the retainer portion 1204, and therefore movement of the connector portion 1206 and the basin accessory 1202 (e.g., relative to the front wall 108, etc.). Similarly, contact between the retainer portion 1204 and lip wall 1004 may limit or resist movement of the retainer portion 1204, and therefore movement of the connector portion 1206 and the basin accessory 1202 (e.g., relative to the front wall 108, etc.).

Additionally, contact between the retainer portion 1204 and the wall 1008 may limit or resist movement of the retainer portion 1204, and therefore movement of the connector portion 1206 and the basin accessory 1202 (e.g., relative to the second side wall 114, etc.). Similarly, contact between the retainer portion 1204 and lip wall 1012 may limit or resist movement of the retainer portion 1204, and therefore movement of the connector portion 1206 and the basin accessory 1202 (e.g., relative to the second side wall 114, etc.).

When the basin accessory 902 is secured within the basin channel 900, the connector portion 1206 extends out of the basin channel 900. As shown in FIG. 12, the basin channel 900 extends between the wall 1000 and the lip wall 1004 as well as between the wall 1008 and the lip wall 1012. In various embodiments, the basin channel 900 is configured such that the basin accessory 902 can be selectively repositioned (e.g., slid, etc.) along the basin channel 900 (e.g., from a position proximate the first side wall 110 to a position proximate the second side wall 114, etc.).

To secure the basin accessory 902 to the basin channel 900, the retainer portion 1204 is first inserted into the basin channel 900. As shown in FIG. 12, the retainer portion 1204 is first inserted between the wall 1000 and the lip wall 1004 and between the wall 1008 and the lip wall 1012. Then, the basin accessory 902 is rotated and the connector portion 1206 is caused to interface with the wall 1008. In some embodiments, the connector portion 1206 may interface with the wall 1008 as the retainer portion 1204 interfaces with the lip wall 1012.

In various embodiments, the basin accessory 1202 is a sponge holder, a brush holder, or a soap holder (e.g., container, cup, tray, etc.). In other embodiments, the basin accessory 1202 is a drying rack (e.g., wine glass drying rack, utensil drying rack, etc.).

V. Example Sink System with Basin Rail

Figure 13:
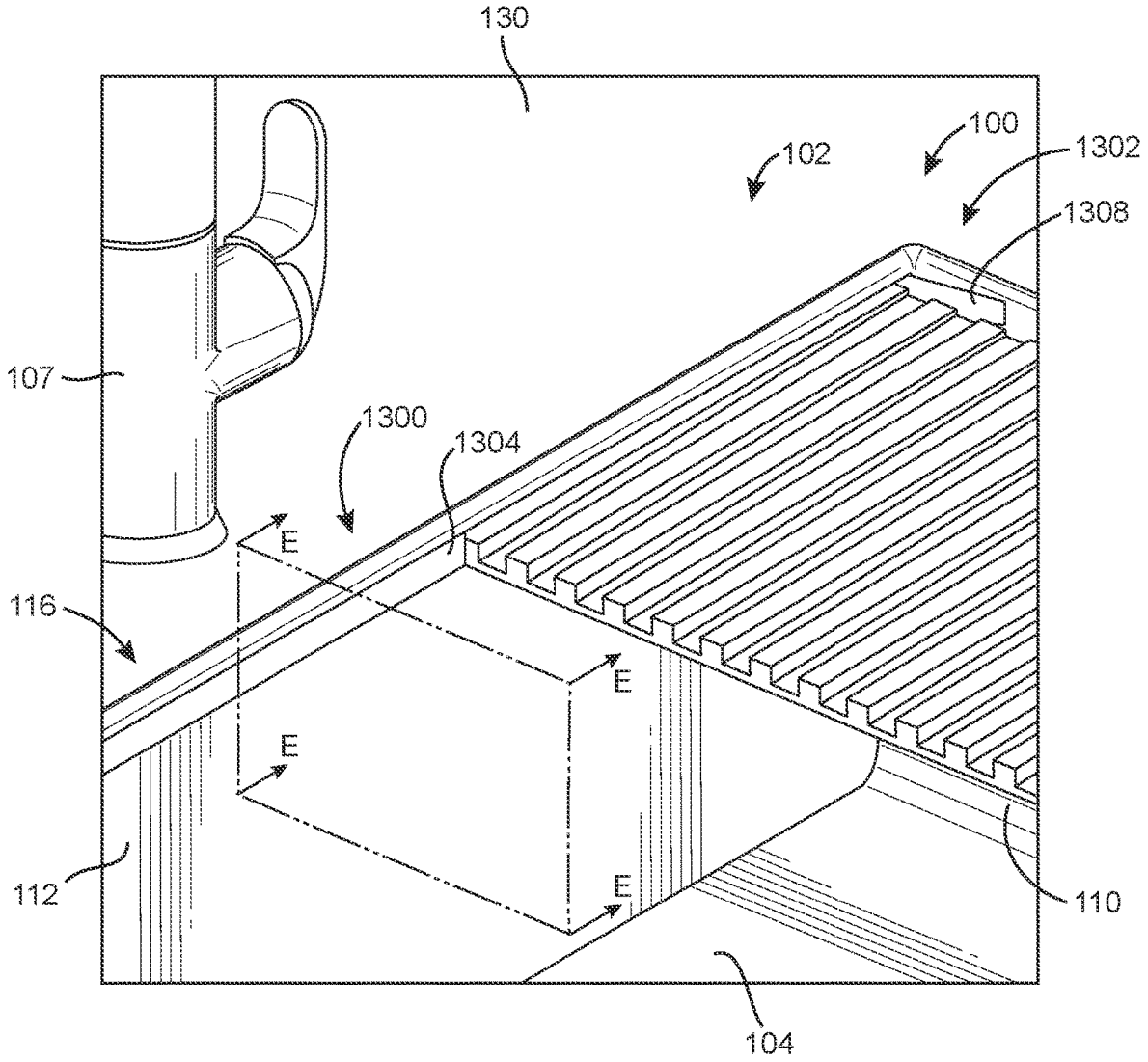
FIG. 13 is a top perspective view of a sink system according to another example embodiment.
Figure 14:
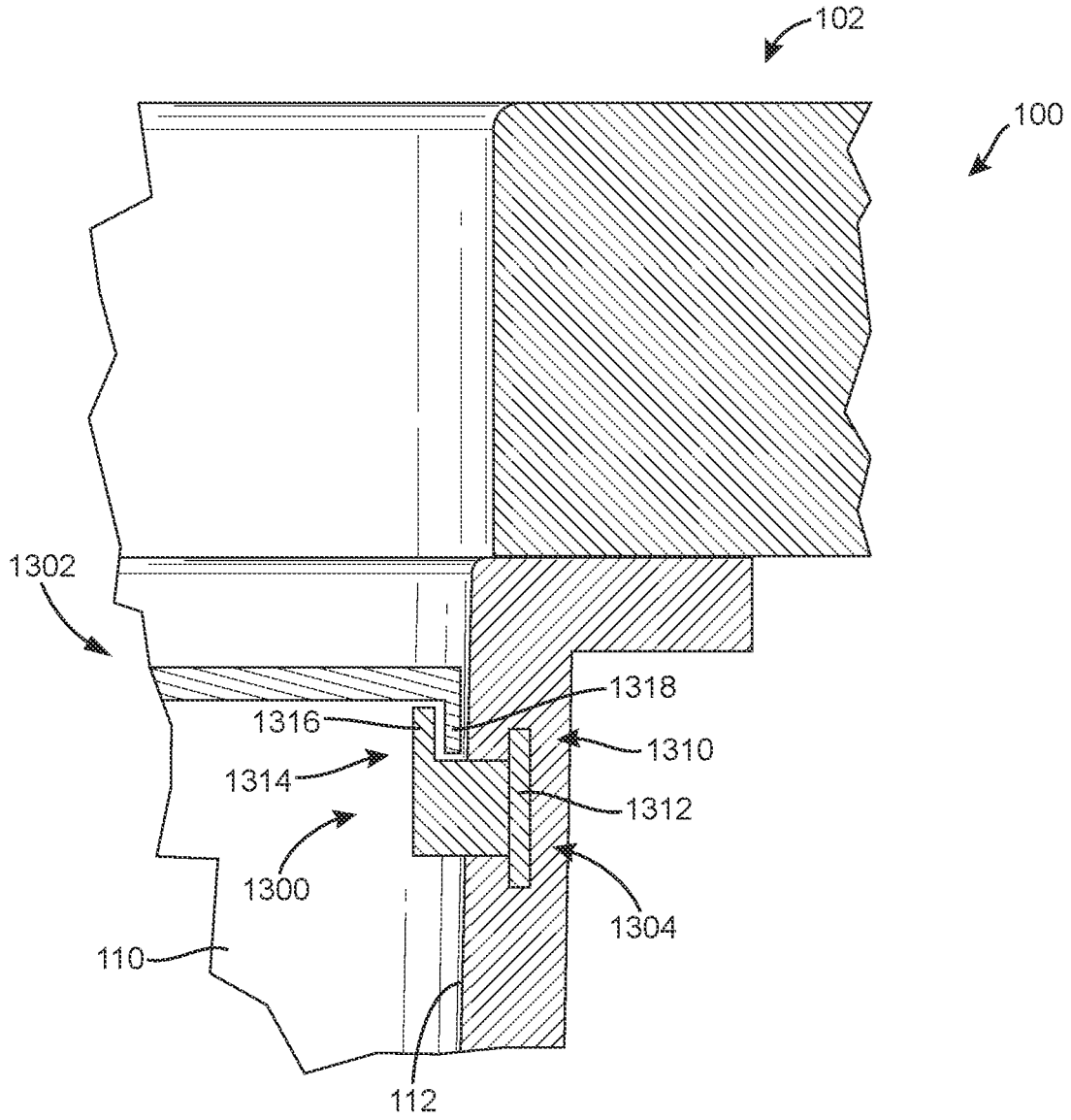
FIG. 14 is another cross-sectional view of the sink system shown in FIG. 13 taken along plane E-E.

FIGS. 13 and 14 illustrate portions of the sink system 100 according to various embodiments. The sink system 100 includes a basin rail that supports a basin accessory within the basin. The basin rail protrudes from the basin such that the basin accessory may rest on two basin rails, such as a basin rail on a front side of the basin and a basin rail on the rear side of the basin. The basin accessory may be, for example, a drain board. As a result of extending across the basin, water from the basin accessory may drain into the basin.

The basin 102 includes at least one basin rail 1300. As is explained in more detail herein, the sink system 100 also includes a basin rail accessory 1302 that is configured to be secured to the basin rail 1300 and removed from the basin rail 1300 without any modification to the basin 102. As is explained in more detail herein, the basin rail accessory 1302 provides additional functionality to the sink system 100, thereby increasing the desirability of the sink system 100. Additionally, because the basin rail accessory 1302 is secured to the basin rail 1300 only via a connection at the basin rail 1300, the basin rail accessory 1302 is suspended above the floor 104. This suspension may make the basin rail accessory 1302 more desirable than other basin accessories which rest on a countertop, and therefore take up counter space, or rest on a sink bottom, and therefore take up sink space (e.g., larger items are unable to rest on the sink bottom, etc.) and/or accumulate grime due to water present on the sink bottom.

The basin rail 1300 includes a basin rail support 1304. The basin rail support 1304 extends along one of the front wall 108, the first side wall 110, the rear wall 112, or the second side wall 114. As is described in more detail herein, a portion of the basin rail support 1304 is coupled to one of the front wall 108, the first side wall 110, the rear wall 112, or the second side wall 114, thereby supporting the basin rail 1300 within the basin 102.

In some embodiments, the basin rail 1300 also includes a first end 1306. The first end 1306 is contiguous with the basin rail support 1304. The first end 1306 extends along one of the front wall 108, the first side wall 110, the rear wall 112, or the second side wall 114. In some embodiments, a portion of the first end 1306 may be coupled to one of the front wall 108, the first side wall 110, the rear wall 112, or the second side wall 114, thereby supporting the basin rail 1300 within the basin 102.

In some embodiments, the basin rail 1300 also includes a second end 1308 in addition to the first end 1306. The second end 1308 is contiguous with the basin rail support 1304 and is separated from the first end 1306 by the basin rail support 1304. The second end 1308 extends along one of the front wall 108, the first side wall 110, the rear wall 112, or the second side wall 114. In some embodiments, a portion of the second end 1308 may be coupled to one of the front wall 108, the first side wall 110, the rear wall 112, or the second side wall 114, thereby supporting the basin rail 1300 within the basin 102.

The basin rail support 1304 includes an attachment portion 1310. The attachment portion 1310 is coupled to one of the front wall 108, the first side wall 110, the rear wall 112, or the second side wall 114, thereby supporting the basin rail 1300 within the basin 102. As shown in FIG. 14, the attachment portion 1310 is coupled to the rear wall 112. However, it is understood that the attachment portion 1310 may similarly be coupled to the front wall 108, the first side wall 110, or the second side wall 114.

The attachment portion 1310 includes an attachment portion cleat 1312 (e.g., foot, prong, projection, etc.). The attachment portion cleat 1312 may facilitate coupling of the attachment portion 1310 to one of the front wall 108, the first side wall 110, the rear wall 112, or the second side wall 114. For example, the attachment portion cleat 1312 may be configured to be received within a recess formed in one of the front wall 108, the first side wall 110, the rear wall 112, or the second side wall 114. In another example, the attachment portion cleat 1312 may be encased (e.g., encapsulated, surrounded, etc.) in one of the front wall 108, the first side wall 110, the rear wall 112, or the second side wall 114 (e.g., the attachment portion cleat 1312 is encapsulated by being surrounded by molding material used to form the basin 102, etc.).

The basin rail support 1304 includes an interfacing portion 1314. The interfacing portion 1314 is contiguous with the attachment portion 1310. The interfacing portion 1314 is configured to interface with the basin rail accessory 1302 to support the basin rail accessory 1302 within the basin 102.

In various embodiments, the interfacing portion 1314 includes an interfacing portion flange 1316. The interfacing portion flange 1316 is configured to interface with an accessory flange 1318 of the basin rail accessory 1302. As a result, the accessory flange 1318 is captured between the interfacing portion flange 1316 and one of the front wall 108, the first side wall 110, the rear wall 112, or the second side wall 114, thereby resisting movement of the basin rail accessory 1302 relative to the basin 102.

In various embodiments, the sink system 100 includes a first basin rail 1300 and a second basin rail 1300. In these embodiments, the first basin rail 1300 is coupled to one of the front wall 108, the first side wall 110, the rear wall 112, or the second side wall 114 and the second basin rail 1300 is coupled to another of the one of the front wall 108, the first side wall 110, the rear wall 112, or the second side wall 114. For example, the first basin rail 1300 may be coupled to the front wall 108 and the second basin rail 1300 may be coupled to the rear wall 112. In another example, the first basin rail 1300 may be coupled to the first side wall 110 and the second basin rail 1300 may be coupled to the second side wall 114.

VI. Example Sink System with Basin Shelf

Figure 15:
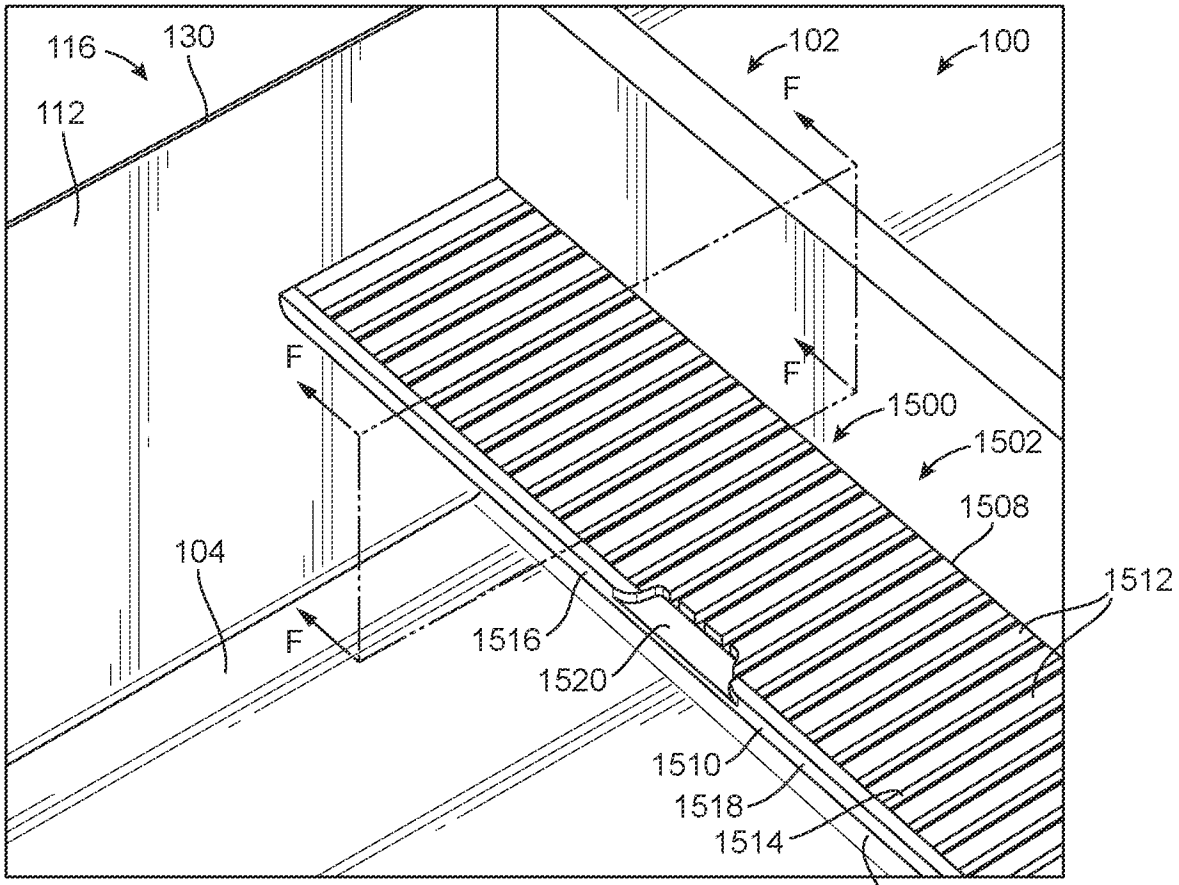
FIG. 15 is a top perspective view of a sink system according to another example embodiment.
Figure 16:
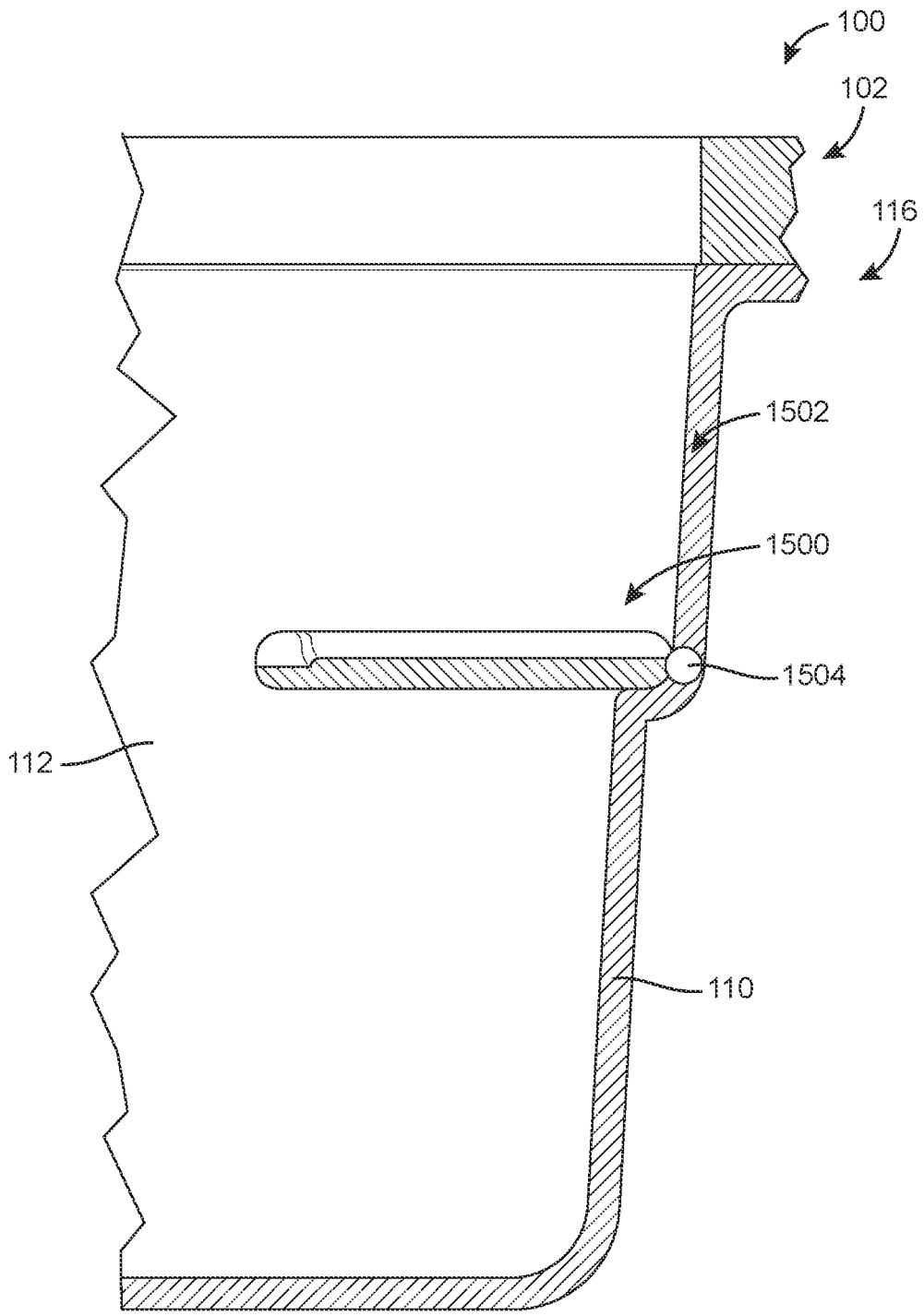
FIG. 16 is a cross-sectional view of the sink system shown in FIG. 15 taken along plane F-F.
Figure 17:
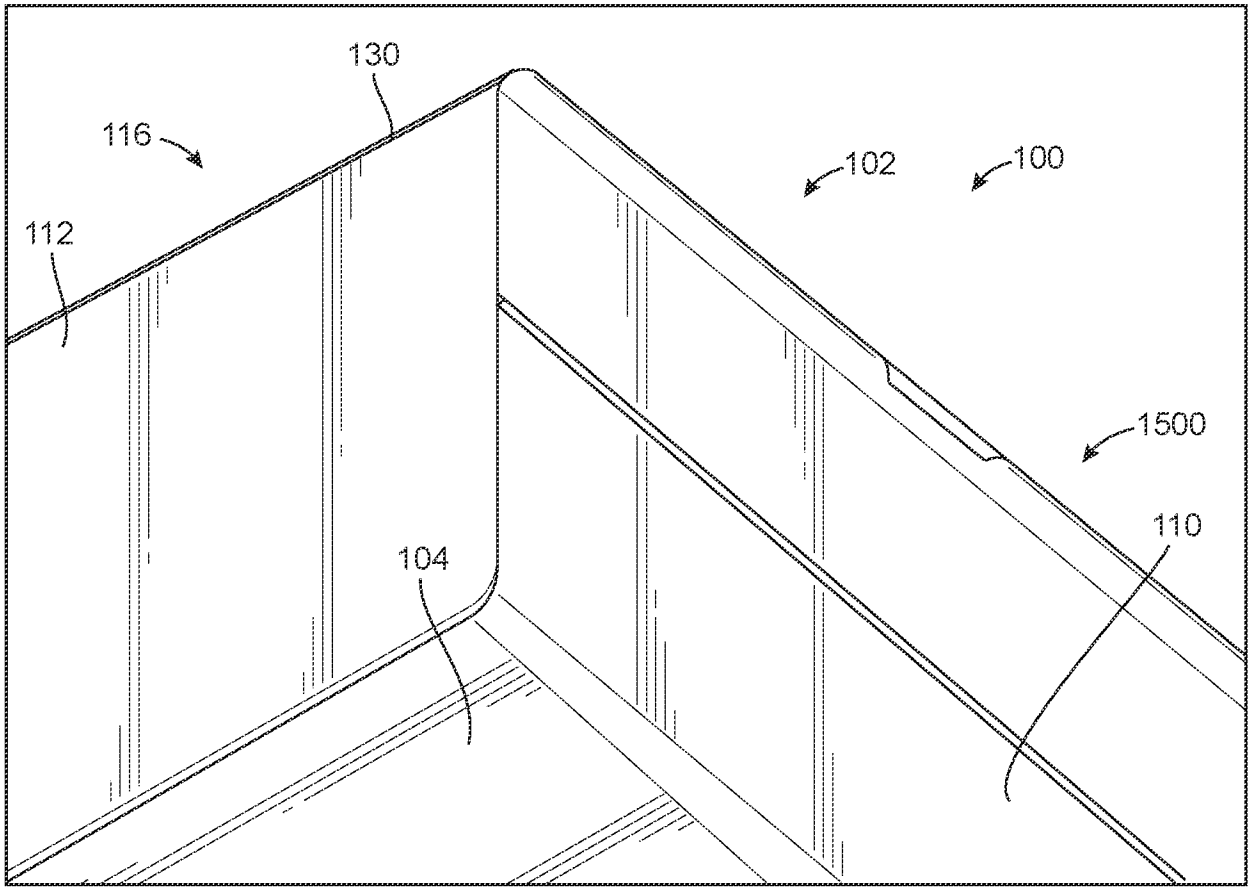
FIG. 17 is another top perspective view of the sink system shown in FIG. 15.

FIGS. 15-17 illustrate portions of the sink system 100 according to various embodiments. The sink system 100 includes a basin shelf which is attached to the basin via a hinge and which folds into a recess in the basin when not in use. In this way, the basin shelf provides a convenient shelf that can be selectively deployed when desired, thereby conserving space within the basin when the basin shelf is not in use.

The basin 102 includes at least one basin wall shelf 1500. As is explained in more detail herein, the basin wall shelf 1500 is operable between a first position, where the basin wall shelf 1500 does not extend into the basin 102, and a second position, where the basin wall shelf 1500 extends into the basin 102. When the basin wall shelf 1500 is in the second position, the basin wall shelf 1500 may be utilized to support items (e.g., dishes, sponges, brushes, soaps, etc.) within the basin 102. When the basin wall shelf 1500 is in the first position, the basin wall shelf 1500 does not obstruct use of the basin 102. As a result, the basin wall shelf 1500 provides additional functionality to the sink system 100, thereby increasing the desirability of the sink system 100.

At least one of the front wall 108, the first side wall 110, the rear wall 112, or the second side wall 114 includes a basin shelf recess 1502. The basin shelf recess 1502 is configured to receive the basin wall shelf 1500 when the basin wall shelf 1500 is in the second position. In embodiments where the sink system 100 includes multiple basin wall shelves 1500, the sink system 100 may include multiple basin shelf recesses 1502, or may include one basin shelf recess 1502 that is configured to receive the basin wall shelves 1500 when the basin wall shelves 1500 are all in the second position. As shown in FIG. 14, the sink system 100 includes a single basin wall shelf 1500 and a single basin shelf recess 1502 that is included in the first side wall 110.

The sink system 100 also includes at least one basin shelf hinge 1504. Each basin shelf hinge 1504 is coupled to one basin wall shelf 1500 and facilitates selectively repositioning of the basin wall shelf 1500 between the first position and the second position. Additionally, each basin shelf hinge 1504 is coupled to at least one of the front wall 108, the first side wall 110, the rear wall 112, or the second side wall 114 includes a basin shelf recess 1502. As shown in FIG. 16, the sink system 100 includes one basin shelf hinge 1504 that is coupled to the first side wall 110.

In an example, the sink system 100 includes one basin shelf recess 1502 in the first side wall 110 and another basin shelf recess 1502 in the second side wall 114. The sink system 100 includes two basin wall shelves 1500, each of the basin wall shelves 1500 coupled to both the front wall 108 and the rear wall 112 via basin shelf hinges 1504. In other words, each basin wall shelf 1500 is coupled to a first basin shelf hinge 1504 that is also coupled to the front wall 108 and a second basin shelf hinge 1504 that is also coupled to the rear wall 112.

In various embodiments, each basin wall shelf 1500 is configured such that the basin wall shelf 1500 contacts one of the front wall 108, the first side wall 110, the rear wall 112, or the second side wall 114 when in both the first position and the second position. As shown in FIG. 16, the basin wall shelf 1500 contacts the first side wall 110 when the basin wall shelf 1500 is in the first position. As shown in FIG. 17, the basin wall shelf 1500 contacts the first side wall 110, within the basin shelf recess 1502, when the basin wall shelf 1500 is in the second position. In this way, movement of the basin wall shelf 1500 is constrained by the basin 102.

The basin wall shelf 1500 includes a central edge 1508 and an outer edge 1510. The central edge 1508 is maintained within the basin shelf recess 1502 as the basin wall shelf 1500 is selectively repositioned between the first position and the second position. However, the outer edge 1510 is rotationally translated (e.g., traces an arc, etc.) as the basin wall shelf 1500 is selectively repositioned between the first position and the second position.

In various embodiments, the basin wall shelf 1500 includes a plurality of flanges 1512. Each of the flanges 1512 is contiguous with the central edge 1508. The flanges 1512 define a plurality of basin shelf channels 1514, each basin shelf channel 1514 being located between two adjacent flanges 1512. As a result of the flanges 1512 being contiguous with central edge 1508, the basin shelf channels 1514 are open at the central edge 1508. As the basin wall shelf 1500 transitions from the second position to the first position, any water on the basin wall shelf 1500 is caused to flow towards the central edge 1508. Rather than being contained between the basin wall shelf 1500 and the basin shelf recess 1502, the water drains off the basin wall shelf 1500 via the basin shelf channels 1514 and flows between the basin wall shelf 1500 and the basin shelf recess 1502, into the basin 102. As a result, the basin wall shelf 1500 is more desirable than other shelves which may be unable to drain easily and may accumulate mold or grime.

In some embodiments, the basin wall shelf 1500 includes a first endcap 1516 that is disposed along the outer edge 1510 and is contiguous with a plurality of the flanges 1512 and a second endcap 1518 that is disposed along the outer edge 1510 and is contiguous with another plurality of the flanges 1512. As a result, the basin shelf channels 1514 are not open along the first endcap 1516 or the second endcap 1518. However, the basin wall shelf 1500 includes a handhold 1520 between the first endcap 1516 and the second endcap 1518 and that is contiguous with at least one of the basin shelf channels 1514. A user can graph the handhold 1520 to reposition the basin wall shelf 1500 between the first position and the second position. Rather than being contained within the handhold 1520, any water within the handhold 1520 drains out of the handhold 1520 via the basin shelf channels 1514. As a result, the basin wall shelf 1500 is more desirable than other shelves which may be unable to drain easily and may accumulate mold or grime.

The basin shelf recess 1502 is configured to have a volume that is approximately equal to a volume of the basin wall shelf 1500 and a shape (e.g., length, width, depth, etc.) that is approximately the same as a shape (e.g., length, width, thickness, etc.) of the basin wall shelf 1500. As a result, the basin shelf recess 1502 is configured to receive the basin wall shelf 1500 such that, when the basin wall shelf 1500 is in the first position, the basin 102 has a flush appearance that is not interrupted by the basin wall shelf 1500. The basin wall shelf 1500 is shown in the first position in FIG. 16. In addition to provide an aesthetic benefit, such a configuration also maximizes available space within the basin 102 when the basin wall shelf 1500 is in the first position.

VII. Example Sink System with Basin Deck

Figure 18:
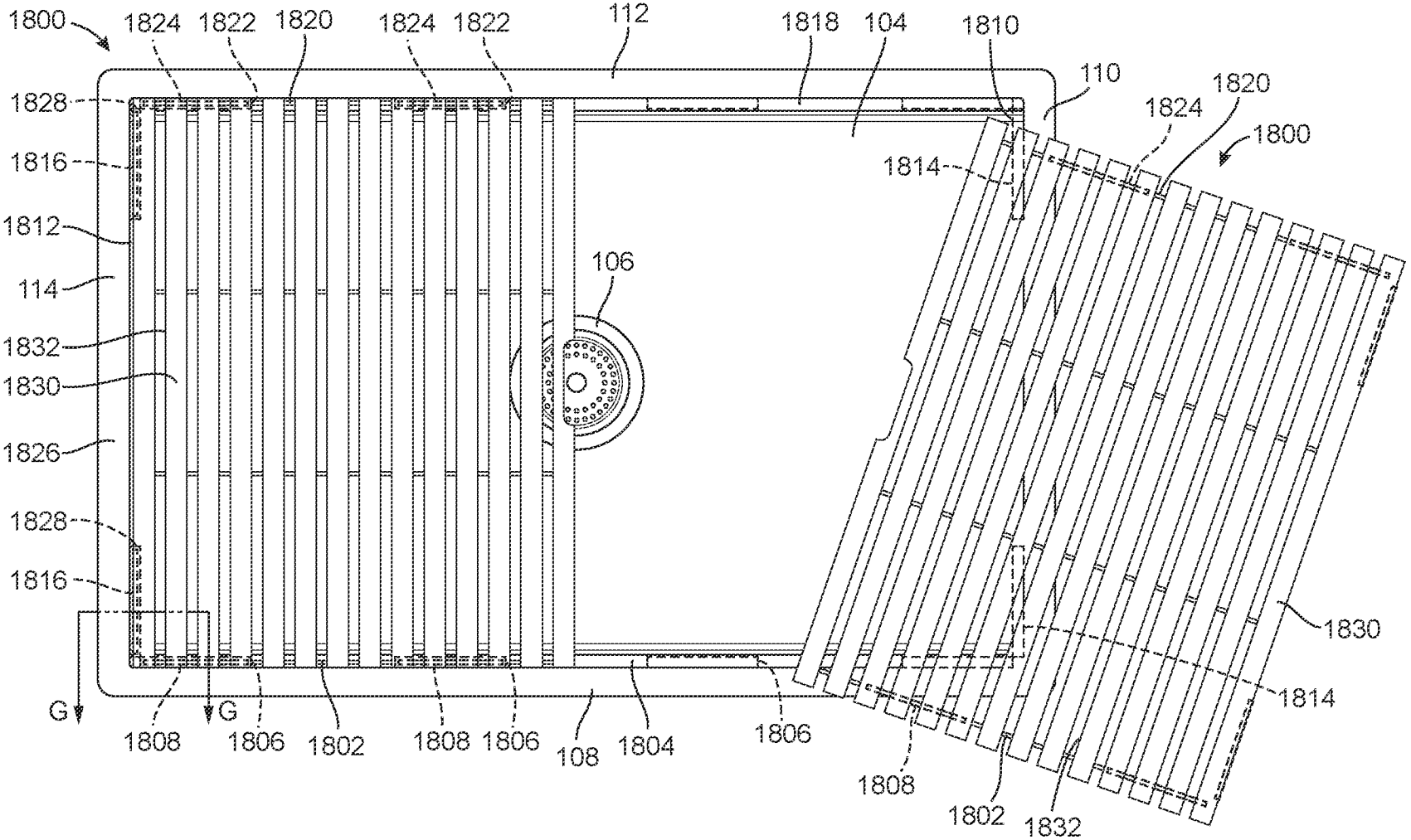
FIG. 18 is a top view of a sink system according to another example embodiment.
Figure 19:
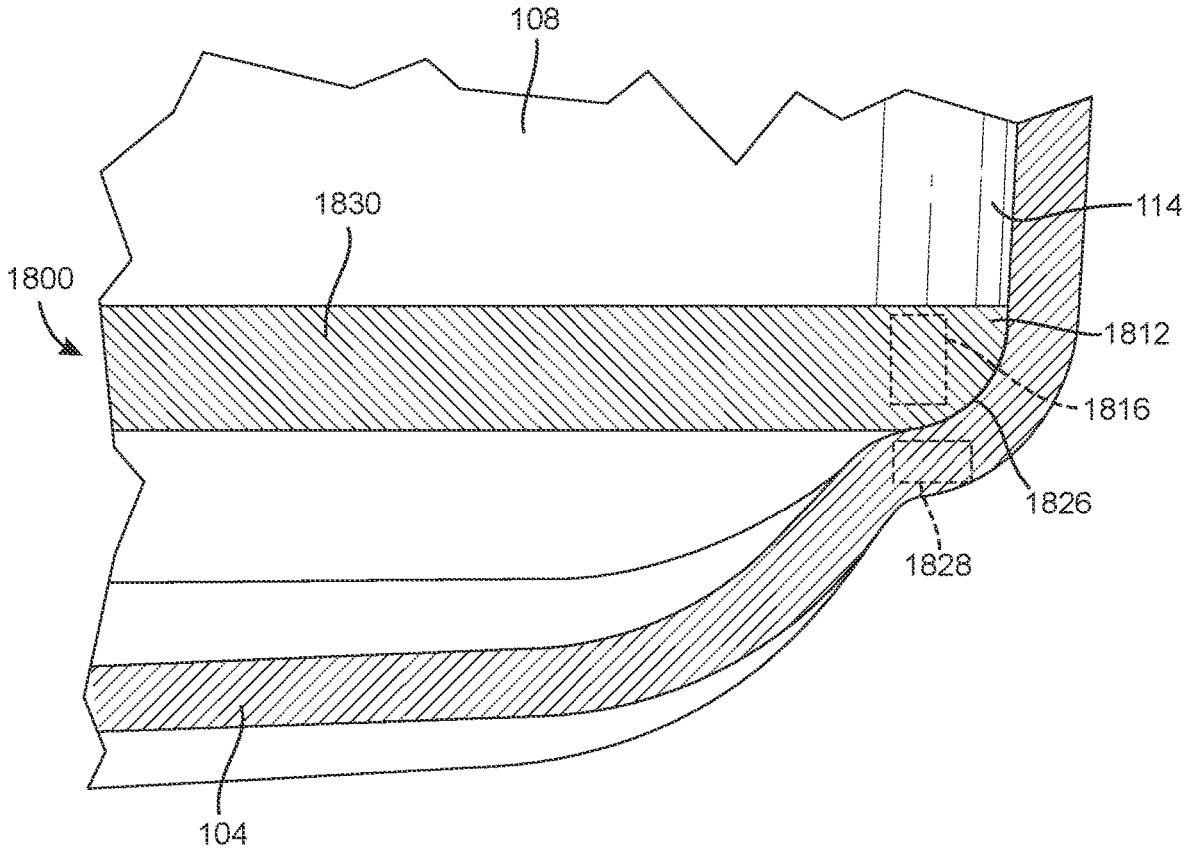
FIG. 19 is a cross-sectional view of the sink system shown in FIG. 18 taken along plane G-G.

FIGS. 18 and 19 illustrate portions of the sink system 100 according to various embodiments. The basin deck extends across a recess in more than one wall of the basin and is supported by these recesses above the floor of the basin. The basin deck may facilitate draining of water therethrough while providing a clean, aesthetically pleasing overlay to the floor of the basin.

The basin 102 includes at least one basin deck 1800. As is explained in more detail herein, the basin deck 1800 is configured to be inserted into, and removed from, the basin 102. When the basin deck 1800 is positioned within the basin 102, the basin deck 1800 may provide a surface above the floor 104. This surface may support items within the basin 102 and may facilitate draining of water from the items through the basin deck 1800 to the floor 104 and subsequently to the drain 106. When the basin deck 1800 is removed from the basin 102, the basin deck 1800 does not obstruct use of the basin 102. As a result, the basin deck 1800 provides additional functionality to the sink system 100, thereby increasing the desirability of the sink system 100.

The front wall 108 includes a front recess 1802. The front recess 1802 extends along at least a portion of the front wall 108. The front recess 1802 is configured to receive a front edge 1804 of the basin deck 1800 when the basin deck 1800 is positioned within the basin 102.

In various embodiments, the front wall 108 includes at least one front coupler 1806 (e.g., magnet, metal component, ferromagnetic component, electromagnetic component, etc.). The front coupler 1806 is disposed proximate the front recess 1802. In these embodiments, the front edge 1804 includes a front deck coupler 1808 (e.g., magnet, metal component, ferromagnetic component, electromagnetic component, etc.). The front deck coupler 1808 is configured to be magnetically coupled to the front coupler 1806 when the basin deck 1800 is positioned within the basin 102. The magnetic coupling between the front deck coupler 1808 and the front coupler 1806 may assist in positioning the basin deck 1800 within the basin 102 and may provide for retention of the basin deck 1800 within the basin 102.

The first side wall 110 includes a first recess 1810. The first recess 1810 extends along at least a portion of the first side wall 110. The first recess 1810 is configured to receive a second side edge 1812 of the basin deck 1800 when the basin deck 1800 is positioned within the basin 102.

In various embodiments, the first side wall 110 includes at least one first side coupler 1814 (e.g., magnet, metal component, ferromagnetic component, electromagnetic component, etc.). The first side coupler 1814 is disposed proximate the first recess 1810. In these embodiments, the second side edge 1812 includes a side deck coupler 1816 (e.g., magnet, metal component, ferromagnetic component, electromagnetic component, etc.). The side deck coupler 1816 is configured to be magnetically coupled to the first side coupler 1814 when the basin deck 1800 is positioned within the basin 102. The magnetic coupling between the side deck coupler 1816 and the first side coupler 1814 may assist in positioning the basin deck 1800 within the basin 102 and may provide for retention of the basin deck 1800 within the basin 102.

The rear wall 112 includes a rear recess 1818. The rear recess 1818 extends along at least a portion of the rear wall 112. The rear recess 1818 is configured to receive a rear edge 1820 of the basin deck 1800 when the basin deck 1800 is positioned within the basin 102.

In various embodiments, the rear wall 112 includes at least one rear wall coupler 1822 (e.g., magnet, metal component, ferromagnetic component, electromagnetic component, etc.). The rear wall coupler 1822 is disposed proximate the rear recess 1818. In these embodiments, the rear edge 1820 includes a rear deck coupler 1824 (e.g., magnet, metal component, ferromagnetic component, electromagnetic component, etc.). The rear deck coupler 1824 is configured to be magnetically coupled to the rear wall coupler 1822 when the basin deck 1800 is positioned within the basin 102. The magnetic coupling between the rear deck coupler 1824 and the rear wall coupler 1822 may assist in positioning the basin deck 1800 within the basin 102 and may provide for retention of the basin deck 1800 within the basin 102.

The second side wall 114 includes a second recess 1826. The second recess 1826 extends along at least a portion of the second side wall 114. The second recess 1826 is configured to receive the second side edge 1812 when the basin deck 1800 is positioned within the basin 102.

In various embodiments, the second side wall 114 includes at least one side deck coupler 1828 (e.g., magnet, metal component, ferromagnetic component, electromagnetic component, etc.). The side deck coupler 1828 is disposed proximate the second recess 1826. In these embodiments, the side deck coupler 1816 is configured to be magnetically coupled to the side deck coupler 1828 when the basin deck 1800 is positioned within the basin 102. The magnetic coupling between the side deck coupler 1816 and the side deck coupler 1828 may assist in positioning the basin deck 1800 within the basin 102 and may provide for retention of the basin deck 1800 within the basin 102.

The front recess 1802, the first recess 1810, the rear recess 1818, and the second recess 1826 are disposed along the same plane. As a result, the basin deck 1800 may be disposed along the same plane as the front recess 1802, the first recess 1810, the rear recess 1818, and the second recess 1826 when the basin deck 1800 is received within the basin 102. This may enable the basin deck 1800 to lay flat within the basin 102 and/or approximately parallel to the floor 104.

The front recess 1802, the first recess 1810, the rear recess 1818, and the second recess 1826 are located such that the basin deck 1800 is suspended above the floor 104. As a result, accumulation of grime on the basin deck 1800 is significantly reduced compared to other decks which have feet that rest on a basin floor.

In various embodiments, the basin deck 1800 includes a plurality of basin deck slats 1830. Each of the basin deck slats 1830 may be contiguous with the front edge 1804 and the rear edge 1820. The basin deck slats 1830 define a plurality of basin deck channels 1832, each basin deck channel 1832 being located between two adjacent basin deck slats 1830. As a result, any water on the basin deck 1800 may flow through the basin deck 1800 (e.g., towards the drain 106, etc.) via the basin deck channels 1832. As a result, the basin deck 1800 is more desirable than other decks which may be unable to drain easily and may accumulate mold or grime.

In various embodiments, the sink system 100 includes two basin decks 1800. In these embodiments, one of the basin decks 1800 is configured to be located within the basin 102 proximate the first side wall 110 and the other basin deck 1800 is configured to be located within the basin deck 1800 proximate the second side wall 114. In some embodiments, the basin decks 1800 are identical.

VIII. Example Sink System with Rim Deck

Figure 20:
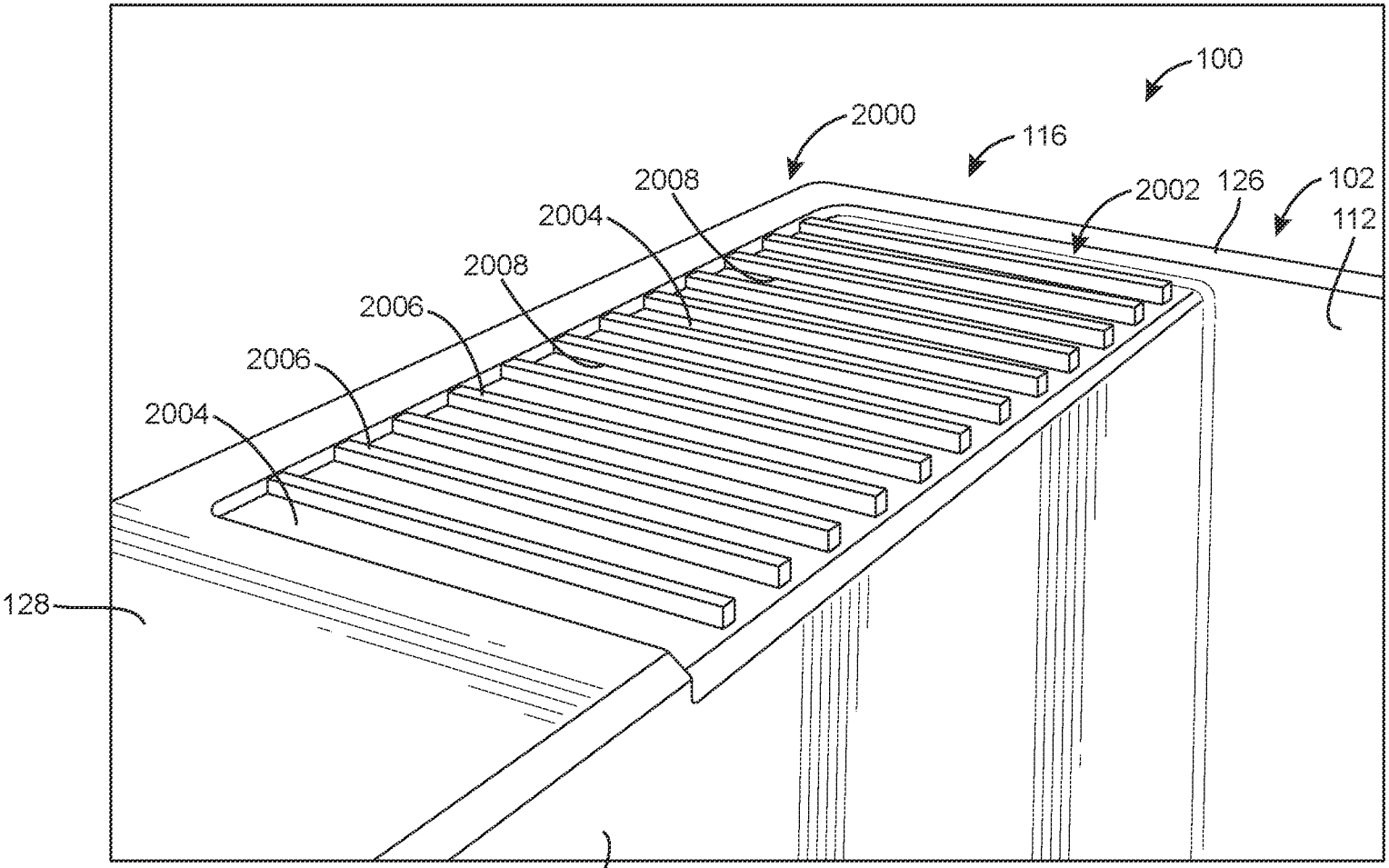
FIG. 20 is a top perspective view of a sink system according to another example embodiment.
Figure 21:
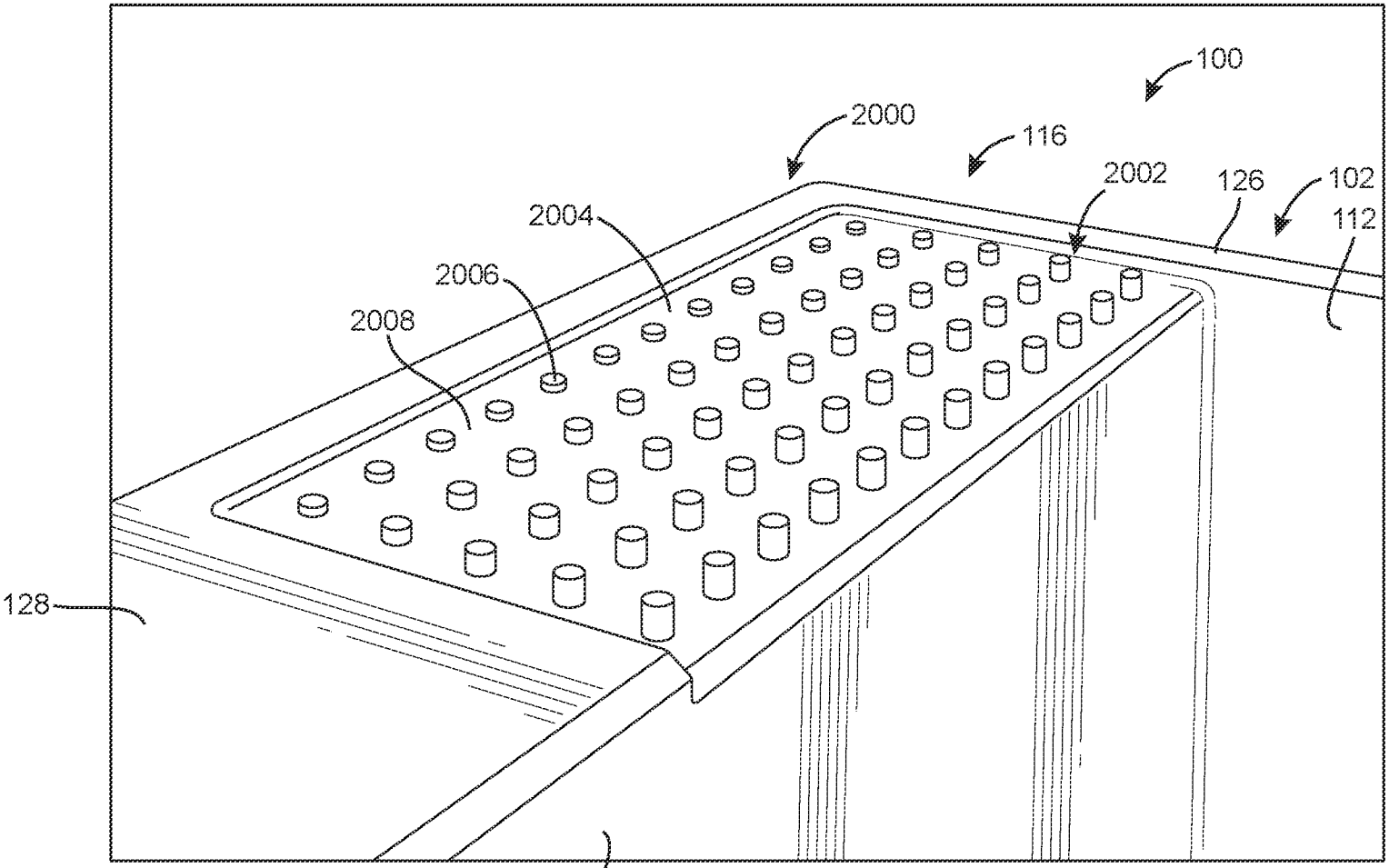
FIG. 21 is a top perspective view of a sink system according to another example embodiment.
Figure 22:
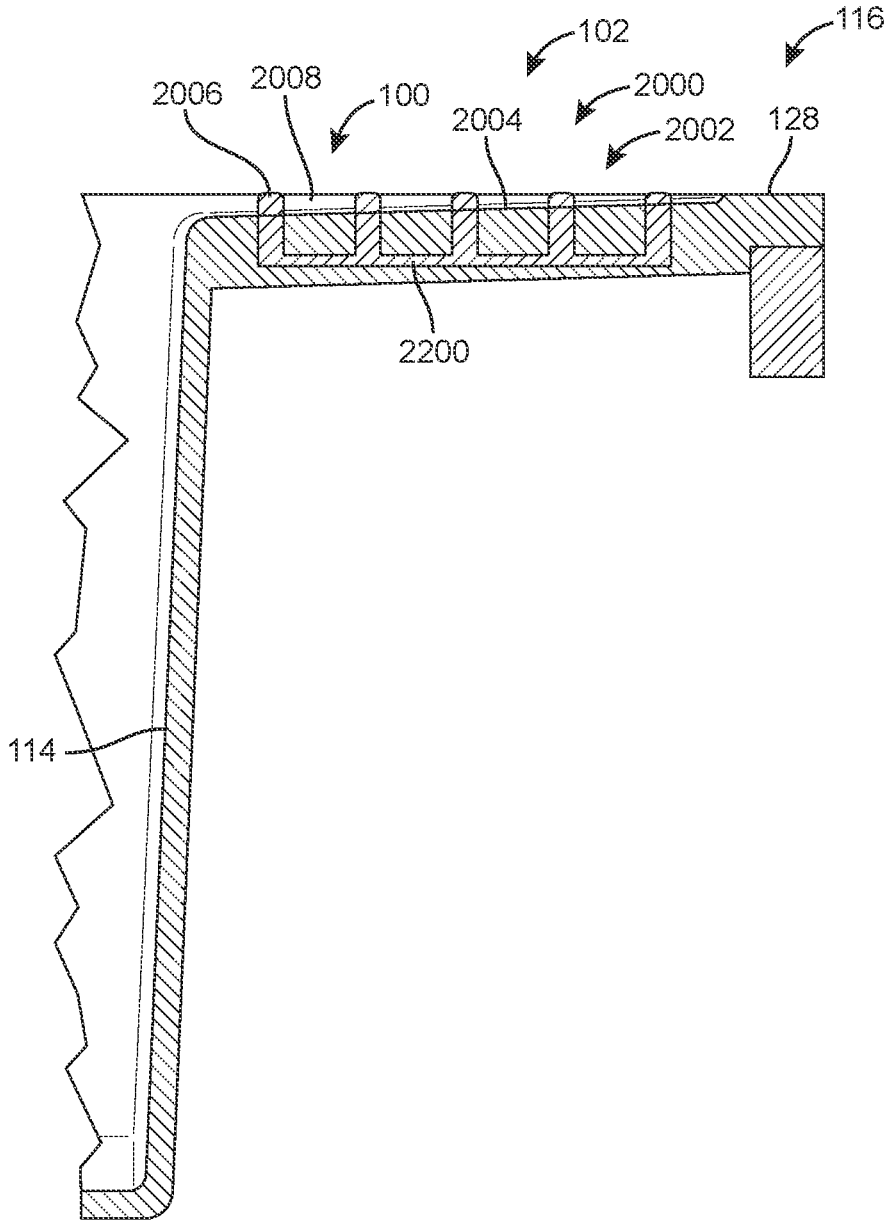
FIG. 22 is a cross-sectional view of a sink system according to another example embodiment.

FIGS. 20-22 illustrate portions of the sink system 100 according to various embodiments. The sink system 100 includes a rim deck that is integrally formed with the rim of the basin. The rim deck has a slanted bottom surface such that items which are placed on supports of the rim deck can drain into the basin via the slanted bottom surface.

The basin rim 116 includes at least one rim deck 2000. As is explained in more detail herein, the rim deck 2000 is configured to support items on the basin rim 116 while simultaneously facilitating draining of water from the items into the basin 102 (e.g., to the drain 106, etc.). Advantageously, the rim deck 2000 is integral with (e.g., built into, etc.) the basin 102, such that the rim deck 2000 cannot become dislodged (e.g., knocked off, etc.) the basin rim 116 during use. As a result, the rim deck 2000 provides additional functionality to the sink system 100, thereby increasing the desirability of the sink system 100.

At least one of the rim front side 122, the rim first side 124, the rim rear side 126, or the rim second side 128 includes the rim deck 2000. The rim deck 2000 includes a rim deck recess 2002. The rim deck recess 2002 is formed in the rim front side 122, the rim first side 124, the rim rear side 126, or the rim second side 128.

The rim deck recess 2002 defines a rim deck surface 2004. The rim deck surface 2004 is sloped (e.g., curved, slanted, angled, etc.) so as to facilitate draining of water on the rim deck surface 2004 into the basin 102 and to the drain 106.

The rim deck 2000 also includes a plurality of rim deck supports 2006. Each of the rim deck supports 2006 extends from the rim deck surface 2004. In some embodiments, such as is shown in FIGS. 20 and 22, the rim deck supports 2006 are ribs (e.g., flanges, etc.). In other embodiments, such as is shown in FIG. 22, the rim deck supports 2006 are posts.

The rim deck supports 2006 define a plurality of rim deck channels 2008, each rim deck channel 2008 being located between at least two adjacent rim deck supports 2006. As a result, any water on the rim deck 2000 may flow through the rim deck 2000 (e.g., towards the drain 106, etc.) via the rim deck channels 2008. As a result, the rim deck 2000 is more desirable than other decks which may be unable to drain easily and may accumulate mold or grime.

As shown in FIG. 22, the rim deck 2000 may be a single structure that is encased (e.g., encapsulated, surrounded, etc.) in one of the rim front side 122, the rim first side 124, the rim rear side 126, or the rim second side 128. Specifically, the rim deck supports 2006 are each integrally formed with a rim deck base 2200 that is at least partially encapsulated by being surrounded by molding material (e.g., used to form the rim front side 122, used to form the rim first side 124, used to form the rim rear side 126, used to form the rim second side 128, etc.). In some embodiments, the rim deck surface 2004 may be formed in the rim deck base 2200 and the rim deck base 2200 may protrude from one of the rim front side 122, the rim first side 124, the rim rear side 126, or the rim second side 128.

In various embodiments, the rim deck 2000 (e.g., the rim deck supports 2006, the rim deck base 2200) are formed from a first material (e.g., aluminum, stainless steel, metal, ceramic, plastic, composite, etc.) and the rim front side 122, the rim first side 124, the rim rear side 126, or the rim second side 128 associated with the rim deck 2000 is formed from a second material (e.g., plastic, ceramic, composite, etc.) different from the first material.

IX. Example Sink System with Drain Cover System

Figure 23:
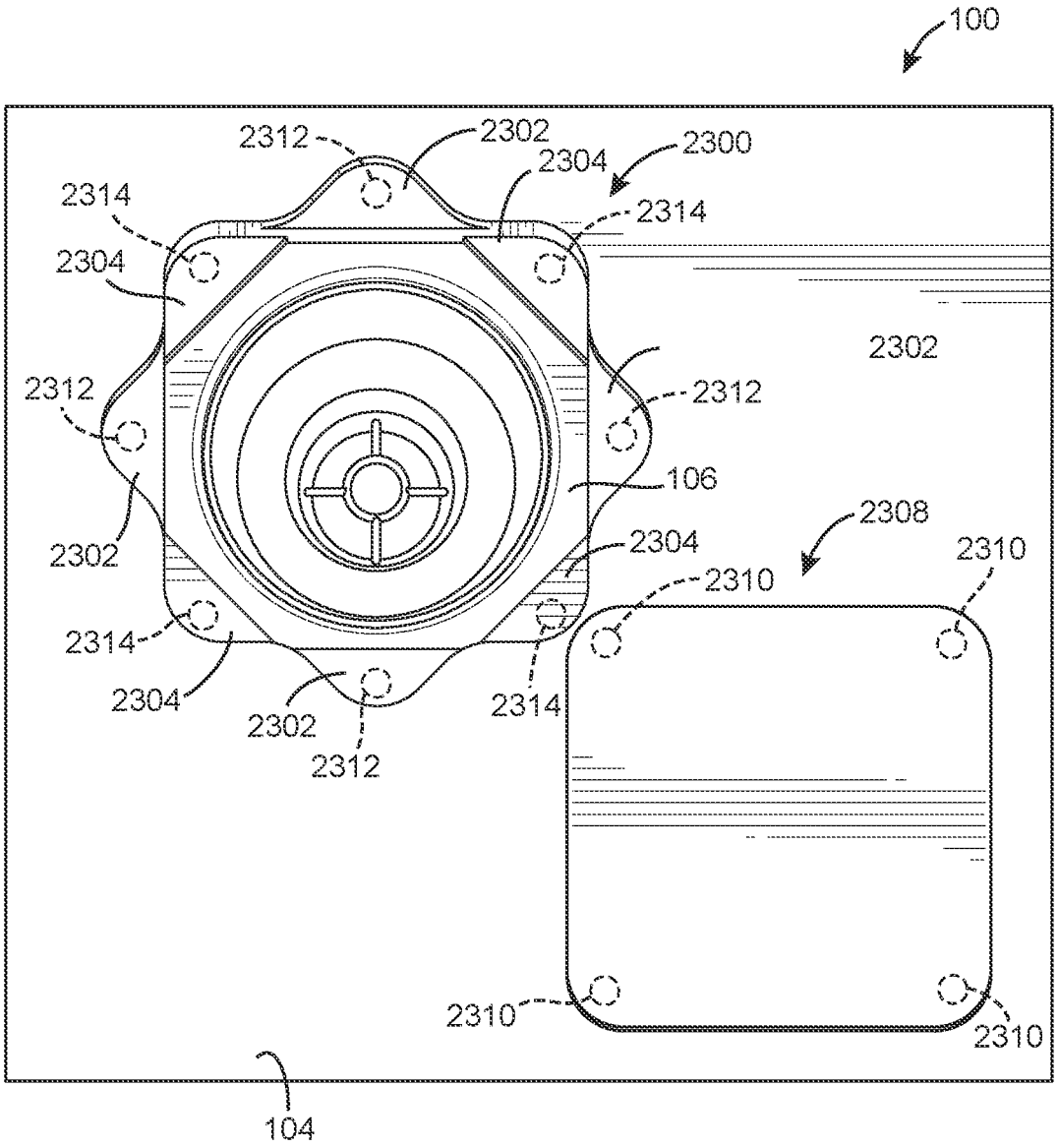
FIG. 23 is a top view of a sink system according to another example embodiment.
Figure 24:
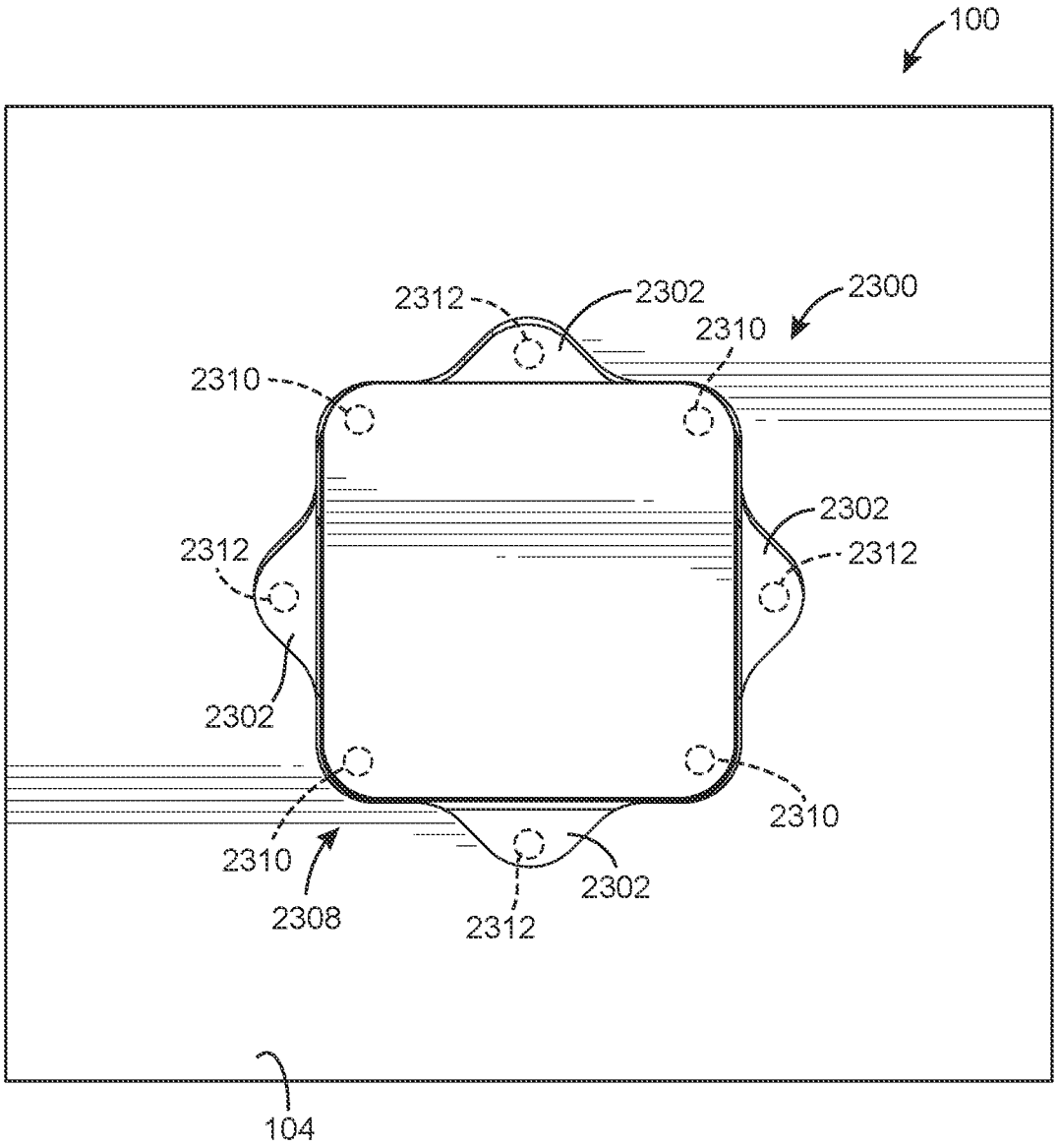
FIG. 24 is another top view of the sink system shown in FIG. 23.

FIGS. 23 and 24 illustrate portions of the sink system 100 according to various embodiments. The sink system 100 includes a drain cover system that includes a drain cover and two separate recesses formed in the floor of the basin. The drain cover can be received in either recess. The recesses have different depths, such that the drain is sealed when the drain cover is received in one recess and not sealed when the drain cover is received in the other recess. The drain cover provides a simple, aesthetically pleasing mechanism for controlling flow of water out of the basin.

The basin 102 includes a drain cover system 2300. As is explained in more detail herein, the drain cover system 2300 is disposed over the drain 106 and is operable between a first position, where flow of water from the basin 102 into the drain 106 is facilitated by the drain cover system 2300, and a second position, where flow of water from the basin 102 into the drain 106 is prohibited by the drain cover system 2300.

As is explained in more detail herein, the drain cover system 2300 provides a mechanism for selectively plugging the drain 106 using a drain cover that is magnetically coupled to the floor 104 and that provides the floor 104 with a flush appearance. As a result, the drain cover system 2300 provides additional functionality to the sink system 100, thereby increasing the desirability of the sink system 100.

The drain cover system 2300 includes a first recess 2302 formed in the floor 104 over the drain 106. In other words, the drain 106 extends through the first recess 2302. The first recess 2302 is defined by a first recess shape (e.g., square, rectangular, triangular, polygonal, star-shaped, etc.) and a first recess depth.

The drain cover system 2300 also includes a second recess 2304 formed in the floor 104 over the drain 106. In other words, the drain 106 extends through the second recess 2304. Additionally, the second recess 2304 is contiguous with the first recess 2302. The second recess 2304 is defined by a second recess shape (e.g., square, rectangular, triangular, polygonal, star-shaped, etc.) and a second recess depth. The second recess depth is greater than the first recess depth. The second recess shape is the same as the first recess shape.

The second recess 2304 is not aligned with the first recess 2302. Instead, the second recess 2304 is rotated an angular distance a relative to the first recess 2302 and about a drain center axis 2306 on which the drain 106 is centered. In various embodiments, the a is approximately equal to 45 degrees. In other examples, the a may be approximately equal to 30 degrees, 90 degrees, or 180 degrees.

The drain cover system 2300 also includes a drain cover 2308 (e.g., lid, etc.). The drain cover 2308 is configured to be received within the first recess 2302 when the drain cover system 2300 is in the first position and is configured to be received within the second recess 2304 when the drain cover system 2300 is in the second position. The drain cover 2308 is defined by a cover shape and a cover depth. The cover shape is the same as the first recess shape and the second recess shape. The cover depth is the same as the first recess depth. In some embodiments, an entirety of the drain cover 2308 is formed from a magnet, metal, a magnetic material, and/or a ferromagnetic material.

When the drain cover 2308 is received within the first recess 2302, the second recess 2304 is uncovered. Due to the difference between the first recess depth and the second recess depth, a gap is formed between the drain cover 2308 and the floor 104 as the second recess 2304. This gap facilitates flow of water through the drain cover system 2300 when the drain cover system 2300 is in the first position.

In various embodiments, a thickness of the drain cover 2308 is approximately equal to the first recess depth. As a result, the floor 104 and the drain cover system 2300 have a generally flush appearance when the drain cover system 2300 is in the first position.

When the drain cover 2308 is received within the second recess 2304, the second recess 2304 is covered. Due to the match between the second recess shape and the cover shape, a seal is formed between the drain cover 2308 and the second recess 2304. This seal prohibits flow of water through the drain cover system 2300 when the drain cover system 2300 is in the second position.

In various embodiments, the drain cover 2308 includes at least one drain cover coupler 2310 (e.g., magnet, metal component, ferromagnetic component, electromagnetic component, etc.). The drain cover coupler 2310 is disposed proximate a corner of the drain cover 2308. Similarly, the floor 104 includes at least one first recess coupler 2312 (e.g., magnet, metal component, ferromagnetic component, electromagnetic component, etc.). The first recess coupler 2312 is disposed proximate the first recess 2302. The drain cover coupler 2310 is configured to be magnetically coupled to the first recess coupler 2312 when the drain cover system 2300 is in the first position. The magnetic coupling between the drain cover coupler 2310 and the first recess coupler 2312 may assist in positioning the drain cover system 2300 in the first position and may provide for retention of the drain cover system 2300 in the first position. Similarly, the floor 104 includes at least one second recess coupler 2314 (e.g., magnet, metal component, ferromagnetic component, electromagnetic component, etc.). The second recess coupler 2314 is disposed proximate the second recess 2304. The drain cover coupler 2310 is configured to be magnetically coupled to the second recess coupler 2314 when the drain cover system 2300 is in the second position. The magnetic coupling between the drain cover coupler 2310 and the second recess coupler 2314 may assist in positioning the drain cover system 2300 in the second position and may provide for retention of the drain cover system 2300 in the second position.

X. Construction of Example Embodiments

While this specification contains many specific implementation details, these should not be construed as limitations on the scope of what may be claimed but rather as descriptions of features specific to particular implementations. Certain features described in this specification in the context of separate implementations can also be implemented in combination in a single implementation. Conversely, various features described in the context of a single implementation can also be implemented in multiple implementations separately or in any suitable subcombination. Moreover, although features may be described as acting in certain combinations and even initially claimed as such, one or more features from a claimed combination can, in some cases, be excised from the combination, and the claimed combination may be directed to a subcombination or variation of a subcombination.

As utilized herein, the term "approximately," "generally," and similar terms are intended to have a broad meaning in harmony with the common and accepted usage by those of ordinary skill in the art to which the subject matter of this disclosure pertains. It should be understood by those of skill in the art who review this disclosure that these terms are intended to allow a description of certain features described and claimed without restricting the scope of these features to the precise numerical ranges provided. Accordingly, these terms should be interpreted as indicating that insubstantial or inconsequential modifications or alterations of the subject matter described and claimed are considered to be within the scope of the present disclosure as recited in the appended claims.

The term "coupled" and the like, as used herein, mean the joining of two components directly or indirectly to one another. Such joining may be stationary (e.g., permanent) or moveable (e.g., removable or releasable). Such joining may be achieved with the two components or the two components and any additional intermediate components being integrally formed as a single unitary body with one another, with the two components, or with the two components and any additional intermediate components being attached to one another.

It is important to note that the construction and arrangement of the system shown in the various example implementations is illustrative only and not restrictive in character. All changes and modifications that come within the spirit and/or scope of the described implementations are desired to be protected. It should be understood that some features may not be necessary, and implementations lacking the various features may be contemplated as within the scope of the application, the scope being defined by the claims that follow. When the language "a portion" is used, the item can include a portion and/or the entire item unless specifically stated to the contrary.

Also, the term "or" is used in its inclusive sense (and not in its exclusive sense) so that when used, for example, to connect a list of elements, the term "or" means one, some, or all of the elements in the list. Conjunctive language such as the phrase "at least one of X, Y, and Z," unless specifically stated otherwise, is otherwise understood with the context as used in general to convey that an item, term, etc. may be either X, Y, Z, X and Y, X and Z, Y and Z, or X, Y, and Z (i.e., any combination of X, Y, and Z). Thus, such conjunctive language is not generally intended to imply that certain embodiments require at least one of X, at least one of Y, and at least one of Z to each be present, unless otherwise indicated.

Additionally, the use of ranges of values (e.g., W to P, etc.) herein are inclusive of their maximum values and minimum values (e.g., W to P includes W and includes P, etc.), unless otherwise indicated. Furthermore, a range of values (e.g., W to P, etc.) does not necessarily require the inclusion of intermediate values within the range of values (e.g., W to P can include only W and P, etc.), unless otherwise indicated.

What is claimed is:

1. A sink system comprising:

a basin comprising:

a floor;

a front wall contiguous with the floor; and a basin rim having a rim front side contiguous with the front wall, the rim front side comprising an aperture; and an apron comprising an apron coupling wall configured to be coupled to the rim front side, the apron coupling wall comprising an apron slot that is configured to be aligned with the aperture when the apron is coupled to the basin rim, wherein:

the rim front side further comprises:

a stepped portion; and a rim shelf that is separated from the front wall by the stepped portion; and the apron coupling wall further comprises:

an inner recessed portion that interfaces with the stepped portion when the apron is coupled to the basin; and an apron shelf that interfaces with the rim shelf when the apron is coupled to the basin.

2. The sink system of claim 1, wherein:

the apron coupling wall further comprises an outer recessed portion;

the rim shelf further comprises an attachment recess; and the outer recessed portion and the attachment recess collectively form an apron attachment channel when the apron is coupled to the basin.

3. The sink system of claim 2, further comprising an apron attachment that is configured to be coupled to the basin and the apron when the basin is coupled to the apron, the apron attachment comprising:

a retainer portion that is configured to be inserted into the apron attachment channel; and an apron attachment accessory configured to protrude from the apron when the retainer portion is inserted into the apron attachment channel.

4. The sink system of claim 1, further comprising a basin rim insert that is configured to be received within the aperture, the basin rim insert defining rim insert aperture.

5. The sink system of claim 4, further comprising:

a threaded fastener configured to be received in the aperture and the apron slot; and a nut configured to be threaded on the threaded fastener and to interface with the apron slot to cooperate with the aperture and the rim insert aperture to cause the apron to be coupled to the basin.

6. The sink system of claim 5, wherein:

the apron coupling wall further comprises:

an inner recessed portion that is disposed along a third plane that is separated from the floor by a third distance when the apron is coupled to the basin; and an apron shelf that is disposed along a fourth plane that is separated from the floor by a fourth distance when the apron is coupled to the basin, the fourth distance being greater than the third distance; and the apron slot is disposed in the inner recessed portion.

7. The sink system of claim 1, wherein:

the rim front side further comprises:

a stepped portion disposed along a first plane that is separated from the floor by a first distance; and a rim shelf that is separated from the front wall by the stepped portion, the rim shelf disposed along a second plane that is separated from the floor by a second distance that is greater than the first distance; and the aperture is disposed in the stepped portion.

8. The sink system of claim 1, wherein:

the apron slot is configured to receive a first portion of a threaded fastener when the apron is coupled to the basin rim; and the aperture is configured to receive a second portion of the threaded fastener when the apron is coupled to the basin rim.

9. The sink system of claim 1, wherein the basin further comprises a basin rail that is coupled to the front wall, the basin rail comprising an interfacing portion flange separated from the front wall.

10. The sink system of claim 9, further comprising a basin rail accessory, the basin rail accessory comprising an accessory flange that is configured to be captured between the interfacing portion flange and the front wall;

wherein the basin rail and the front wall cooperate to support the basin rail accessory within the basin when the accessory flange is captured between the interfacing portion flange and the front wall.

11. An apron for a sink system, the apron comprising:

an apron panel wall;

an apron coupling wall contiguous with the apron panel wall, the apron coupling wall comprising:

an inner recessed portion comprising a plurality of apron slots, each of the plurality of apron slots being configured to receive a portion of a threaded fastener, an outer recessed portion;

an apron shelf separating the inner recessed portion from the outer recessed portion;

a first connector wall contiguous with the apron panel wall and the apron coupling wall;

a second connector wall contiguous with the apron panel wall and the apron coupling wall; and an apron spanning wall contiguous with the apron panel wall, the first connector wall, and the second connector wall, the apron spanning wall extending between the first connector wall and the second connector wall;

wherein the apron panel wall, the first connector wall, and the second connector wall extend between the apron coupling wall and the apron spanning wall; and wherein the apron panel wall and the apron coupling wall extend between the first connector wall and the second connector wall.

12. The sink system of claim 11, wherein:

the inner recessed portion is disposed along a first plane;

the outer recessed portion is disposed along a second plane;

the apron shelf is disposed along a third plane;

the third plane is separated from the first plane by a first distance;

the third plane is separated from the second plane by a second distance; and the second distance is less than the first distance.

13. The sink system of claim 11, further comprising an apron connector wall contiguous with the apron panel wall and the apron coupling wall;

wherein the apron coupling wall further comprises:

a central projection extending from the apron shelf and disposed between the inner recessed portion and the outer recessed portion; and an end projection extending from the apron shelf and disposed between the inner recessed portion and the connector wall.

14. A basin for a sink system, the basin comprising:

a floor disposed along a first plane;

a front wall contiguous with the floor; and a basin rim having a rim front side contiguous with the front wall, the rim front side comprising:

a rim shelf disposed along a second plane that is separated from the first plane by a first distance;

an attachment recess disposed in the rim shelf and disposed along a straight line;

a stepped portion contiguous with the front wall, disposed between the front wall and at least a portion of the rim shelf, and disposed along a third plane that is separated from the first plane by a second distance that is less than the first distance; and an aperture disposed in the stepped portion.

15. The basin of claim 14, further comprising a basin rail that is configured to support a basin rail accessory within the basin, the basin rail coupled to the front wall, the basin rail comprising an interfacing portion flange separated from the front wall.

16. The basin of claim 14, further comprising a basin channel contiguous with an interior surface of the front wall, the basin channel configured to receive a portion of a basin accessory such that the basin accessory is suspended above the floor.

17. The basin of claim 14, further comprising:

a first side wall that is contiguous with the floor, the front wall, and the basin rim;

a basin shelf hinge coupled to the first side wall; and a basin wall shelf coupled to the basin shelf hinge and selectively repositionable relative to the first side wall.

18. The basin of claim 14, further comprising:

a first side wall that is contiguous with the floor, the front wall, and the basin rim;

a rear wall that is contiguous with the floor and the first side wall, the rear wall comprising a rear recess; and a basin deck comprising:

a front edge;

a rear edge; and a basin deck slat contiguous with the front edge and the rear edge; wherein the front wall comprises a front recess that is configured to receive the front edge so as to support the basin deck above the floor; and wherein the rear recess is configured to receive the rear edge so as to support the basin deck above the floor.

* * * * *